US005887565A

United States Patent [19]

Ozeki et al.

[11] Patent Number: 5,887,565

[45] Date of Patent: Mar. 30, 1999

[54] LUBRICATING OIL PASSAGE STRUCTURE FOR ENGINE

[75] Inventors: Hisashi Ozeki; Akiteru Ogawa, both of Shizuoka-ken, Japan

[73] Assignee: Suzuki Motor Corporation, Shizuoka, Japan

[21] Appl. No.: 6,647

[22] Filed: Jan. 14, 1998

[30] Foreign Application Priority Data

Jan. 17, 1997 [JP] Japan ..... 9-019815

[51] Int. Cl.[6] ..... F01M 1/00

[52] U.S. Cl. ..... 123/196 R; 184/6.5

[58] Field of Search ..... 123/196 R, 196 M; 184/6.5, 6.8

[56] References Cited

U.S. PATENT DOCUMENTS

| | | | |
|---|---|---|---|
| 3,929,117 | 12/1975 | Green et al. | 123/196 R |
| 4,538,565 | 9/1985 | Hidaka et al. | 123/196 R |
| 4,656,983 | 4/1987 | Anno | 123/196 R |
| 4,922,871 | 5/1990 | Batzill | 123/196 A |
| 5,133,313 | 7/1992 | Inoue et al. | 123/196 R |
| 5,653,205 | 8/1997 | Ozeki | 123/196 R |

FOREIGN PATENT DOCUMENTS 59-119312 8/1984 Japan .

63-123709 8/1988 Japan .

*Primary Examiner*—John T. Kwon

*Attorney, Agent, or Firm*—Flynn, Thiel, Boutell & Tanis, P.C.

[57] ABSTRACT

An improved lubricating oil passage structure for an engine, which includes: a sub-gallery and a main gallery positioned adjacent to one another in a cylinder block; a head-side oil passage and a journal-side oil passage both being communicated to the main gallery and provided in the cylinder block, in which the head-side oil passage is led to an upper surface of the cylinder block, while the journal-side oil passage is inclined so as be oriented toward a journal portion of a crankshaft; a housing-side oil passage communicated to the journal-side oil passage, the housing-side oil passage being provided in a journal housing section of the cylinder block by the use of a spot facing for a housing bolt, the journal housing section supporting the journal portion; a metal-side oil passage communicated to the housing-side oil passage, the metal-side oil passage being provided in the journal housing section at the rear of a journal metal disposed between the journal portion and the journal housing section; and, a chain adjuster-side oil passage communicated to the metal-side oil passage.

11 Claims, 33 Drawing Sheets

LUBRICATING OIL PASSAGE STRUCTURE FOR ENGINE

FIELD OF THE INVENTION

This invention relates to a lubricating oil passage structure for an engine. More particularly, it relates to an improved lubricating oil passage structure for an engine which requires fewer working processes for the various oil passages formed in a cylinder block.

BACKGROUND OF THE INVENTION

In engines, a cylinder block has several different types of oil passages provided therein in order to provide lubrication to moving portions in each section of the engine, and oil fed under pressure from an oil pump is caused to flow through the oil passages.

FIGS. 39–55, as hereinafter described, illustrate a known construction.

In FIG. 39, reference number 302 denotes an engine; 304 a cylinder block; 306 a cylinder head; 308 a cylinder head cover; and, 310 an oil pan. The cylinder block 304 has a crankshaft 312 provided therein, and the crankshaft 312 is rotatably supported thereon. A larger end portion 316 of a connecting rod 314 is disposed on and connected to the crankshaft 312. A piston 320 is positioned on and linked to a smaller end portion 318 of the connecting rod 314.

As shown in FIGS. 40–43, the cylinder block 304 is formed with, e.g., three cylinders 322. In each of the cylinders 322, the piston 320 is reciprocably supported on a sleeve 324.

An oil filter 330 (FIG. 39) is mounted on a filter-mounting surface 328 of an outer portion 326 of the cylinder block 304 through a filter stand 332. Further, a sub-gallery 334 (FIG. 43) and a main gallery 336 are formed in the cylinder block 304. The sub-gallery 334 permits the oil fed under pressure from an oil pump (not shown) to be introduced to the oil filter 330. The main gallery 336 guides the oil from the oil filter 330 so as to be distributed into each section of the engine 302.

As illustrated in FIGS. 44–53, the main gallery 336 is positioned on the top of a skirt portion 338 of the cylinder block 304 adjacent to a cast or press-fit sleeve portion 340. The main gallery 336 is confined or closed at front and rear ends thereof by means of blind taps (not shown). In addition, the main gallery 336 is formed at a position spaced apart from the filter-mounting surface 328. The surface 328 is vertically oriented at the outer portion 326 of the cylinder block 304. Further, a journal-side oil passage 344, through which the oil from the main gallery 336 is introduced into a journal portion 342 of the crankshaft 312, is positioned in the central plane of the journal portion 342. A passage, to which the oil drops from the cylinder head 306, is not formed in the central plane of the journal portion 342. For this reason, in order to introduce the oil from the oil filter 330 into the main gallery 336, the cylinder block 304 is provided with: a first communication oil passage 348 communicated to a stand-mounting lower hole 346 of the filter-mounting surface 328, which hole 346 communicates with the oil filter; a second communication oil passage 350 communicated to the first passage 348 in a direction perpendicular thereto; and, a third communication passage 352 communicated to the second passage 350 in a direction perpendicular thereto, which passage 352 communicates with main gallery 336. In addition, a second communication oil passage-side blind tap-mounting portion 354 is formed at an outer end of the second passage 350 for mounting a blind tap (not shown) thereon. A third communication oil passage-side blind tap-mounting portion 356 is defined at an outer end of the third passage 352 for mounting a blind tap (not shown) thereon. In FIG. 52, a head-side oil passage 358 is provided in the cylinder block 304.

As seen from FIGS. 54 and 55, a cylindrical shaped, filter stand 332 consists of: a one side-threaded portion (external thread) 360 on one side of the filter stand 332; an opposite side-threaded portion (external thread) 362 on the other side of the filter stand 332; and, an incompletely threaded portion 364 between the aforesaid threaded portions 360 and 362. When the oil filter 330 is mounted on the cylinder block 304, the one side-threaded portion 360 is driven into a block side-threaded portion (internal thread) 366 of the cylinder block 304 until reaching the bottom of the latter threaded portion 366. In addition, the oil filter 330 is brought into threading attachment to the opposite side-threaded portion 362. In this case, the incompletely threaded portion 364 causes the filter-mounting surface 328 to project from the stand-mounting surface 366 by distance "D".

An example of such a lubricating oil passage structure is disclosed, e.g., in published Japanese Utility Model Application Laid-Open No. 63-123709. Pursuant to the structure as disclosed therein, lubricating oil passages extend sideward from one end of a cylinder block in a direction of a cylinder row so as to be positioned adjacent to water jackets which extend around engine cylinders. In addition, the lubricating oil passages are communicated at both ends thereof to lubricating oil-distributing passages. The distributing passages are intended for use in the lubrication of a main journal bearing.

An example of an oil filter-mounting structure is disclosed, e.g., in published Japanese Utility Model Application Laid-Open No. 59-119312. Pursuant to such a structure as disclosed therein, there is provided an oil filter, in which a cylindrical housing accommodates a filtering body. The housing is closed at one end, but is open at the other end. At the other end of the housing, a cover plate is fixedly attached to a cap body. The cover plate retains a seal packing. The cap body has a threaded oil outflow aperture punched through the center thereof. The cap body further has a plurality of oil inflow apertures drilled around the preceding oil outflow aperture. The periphery of the cover plate is blocked at the aforesaid open end of the housing in a fluid tight manner. In such an oil filter, the cover plate includes a falling-out-preventing section and a rib relief section. A rib of the sealing packing is inserted in an annular portion of the falling-out-preventing section.

In conventional types of lubricating oil passage structures for engines, an increased number of working or machining processes of various oil passages in the cylinder block is required. In addition, the oil passages other than the main gallery employ blind taps. This causes an inconvenience of respective increases in working costs, component costs, and component-assembling costs.

In addition, since the main gallery is positioned on the top of the skirt portion of the cylinder block, the main gallery is impossible to reinforce the side surface of the skirt portion. Therefore, a reinforcing rib must be provided on the side surface of the skirt portion. This causes another inconvenience of increased weight. Further, since the cast or press-fit sleeve portion is positioned close to the main gallery, there occurs still another inconvenience in that the material porosity is likely to link such sleeve portion and the main gallery together, with a consequential increase in rejection rate of the cylinder block. A yet further inconvenience is that, when an impregnating process is conducted in order to lower such rejection rate, then an increase in a manufacturing process and the like occurs, with a concomitant rise in cost.

Further, since the oil filter and the main gallery are spaced apart from one another by a great distance, additional oil passages must be provided for communicating the oil filter and the main gallery with one another. As a result, the working number of oil passages is increased. In addition, the oil filter projects sideways by a great distance from the outer portion of the cylinder block. This causes a further inconvenience in that the engine is made large in size, and is thus more inconveniently disposed in a vehicle.

A still further inconvenience is that, as illustrated in FIG. 44, a passage, to which the oil falls from the cylinder head, and the journal-side oil passage are impossible to coexist in the width of the journal housing section which supports the journal portion of the crankshaft.

Another inconvenience is that, as illustrated in FIG. 55, if the filter stand is excessively tightened into the cylinder block, cracking or tearing may occur at the opening edge of the stand-mounting portion of the cylinder block (as seen at "A" in FIG. 55). In addition, in order to bring the incompletely threaded portion of the filter stand into a mounting surface of the oil filter, the filter-mounting surface must be caused to project from the stand-mounting surface of the filter stand. This results in a heavy-weighted cylinder block. Further, since the incompletely threaded portion 364 free of threads must be provided at the central portion of the filter stand, then the overall length of the filter stand is made larger. This causes still another inconvenience in that the oil filter largely extends sideways from the outer portion of the cylinder block, thereby resulting in a large-scaled engine, with a concomitant increase in weight of the filter stand.

SUMMARY OF THE INVENTION

In order to overcome the above-mentioned inconveniences, one aspect of the present invention provides a lubricating oil passage structure for an engine, having a crankshaft rotatably supported on a cylinder block of the engine, a connecting rod provided in the cylinder block, in which a larger end portion of the connecting rod is connected to the crankshaft, while a smaller end portion of the connecting rod is linked to a piston, the piston being reciprocably supported in each cylinder of the cylinder block through a sleeve, an oil filter mounted on a filter-mounting surface at an outer surface of the cylinder block, and a sub-gallery and a main gallery, both of the galleries provided in the cylinder block, in which the sub-gallery permits oil fed under pressure from an oil pump to be supplied to the oil filter, while the main gallery introduces the oil from the oil filter into each section of the engine, the improvement comprising: the sub-gallery and the main gallery provided adjacent to one another in the cylinder block; a head-side oil passage and a journal-side oil passage, both of the passages being communicated to the main gallery and provided in the cylinder block, in which the head-side oil passage is led to an upper surface of the cylinder block, while the journal-side oil passage is slanted so as to be oriented toward a journal portion of the crankshaft; a housing-side oil passage communicated to the journal-side oil passage, the housing-side oil passage being provided in a journal housing section of the cylinder block by the use of a spot facing for a housing bolt, the journal housing section supporting the journal portion; a metal-side oil passage communicated to the housing-side oil passage, the metal-side oil passage being provided in the journal housing section at the rear of a journal metal disposed between the journal portion and the journal housing section; and, a chain adjuster-side oil passage communicated to the metal-side oil passage, the chain adjuster-side oil passage being provided in the cylinder block.

Another aspect of the present invention provides a lubricating oil passage structure for an engine having a crankshaft rotatably supported on a cylinder block of the engine, a connecting rod provided in the cylinder block, in which a larger end portion of the connecting rod is connected to the crankshaft, while a smaller end portion of the connecting rod is linked to a piston, the piston being reciprocably provided in each cylinder of the cylinder block through a sleeve, an oil filter mounted on a filter-mounting surface at an outer surface of the cylinder block, and a sub-gallery and a main gallery, both of the galleries being provided in the cylinder block, in which the sub-gallery permits oil fed under pressure from an oil pump to be supplied to the oil filter, while the main gallery introduces the oil from the oil filter into each section of the engine, the improvement comprising: a filter stand for mounting the oil filter on the filter-mounting surface, wherein the filter-mounting surface is provided with a block-side threaded portion, while the entire outer surface of the filter stand is provided with a stand-side threaded portion which is designed for threading attachment to the block-side threaded portion, and wherein a screw-stopping agent is applied to the stand-side threaded portion, and the stand-side threaded portion having the agent carried thereon is threaded into the block-side threaded portion until reaching the bottom of the block-side threaded portion, whereby the oil filter is mounted on the cylinder block.

Pursuant to one aspect of the present invention, the sub-gallery, the main gallery, and various oil passages are uniquely arranged and provided in the cylinder block. This construction decreases working or machining processes of the oil passages, and thus lowers component costs, thereby offering reduced cost. In addition, the lubricating oil passage structure is made lighter in weight. Further, component-assembling costs are reduced. Yet further, the overall lengths of the oil passages are reduce, thereby providing improved lubricating function. Still further, the oil is directly supplied to the chain adjuster immediately after the engine starts up, and thus the chain adjuster can be brought into satisfactory action immediately after the start-up of the engine.

Pursuant to another aspect of the present invention, the entire outer surface of the filter stand is threaded, and then working processes of the filter stand are decreased. Further, even if the stand-side threaded portion of the filter stand is excessively tightened into the block-side threaded portion of the cylinder block, then cracking or tearing is prevented from occurring at the opening edge of a stand-mounting portion of the cylinder block. In addition, since the filter-mounting surface and a surface, on which the filter stand is mounted, can be the same one, then the cylinder block can be made lighter in weight. Further, the filter stand can be made smaller in length and lighter in weight. In addition, the oil filter can be positioned close to the cylinder block when being mounted on the cylinder block. As a result, a smaller-sized engine is achievable.

DETAILED DESCRIPTION

Figure 1:
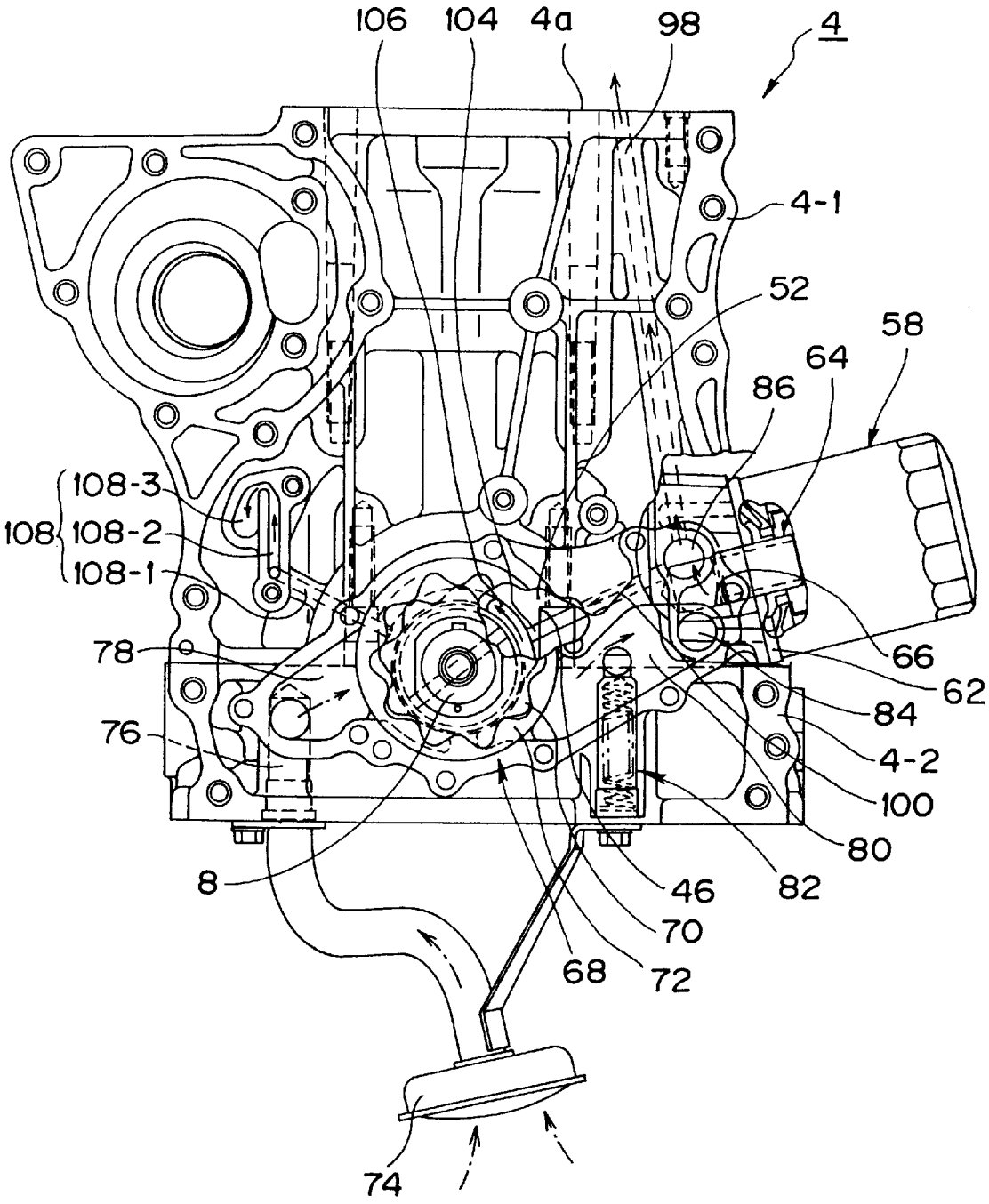
FIG. 1 is a cross-sectional view showing a cylinder block and illustrating flow of oil after filtering by solid arrows, and flow of oil before filtering by dotted arrows.
Figure 2:
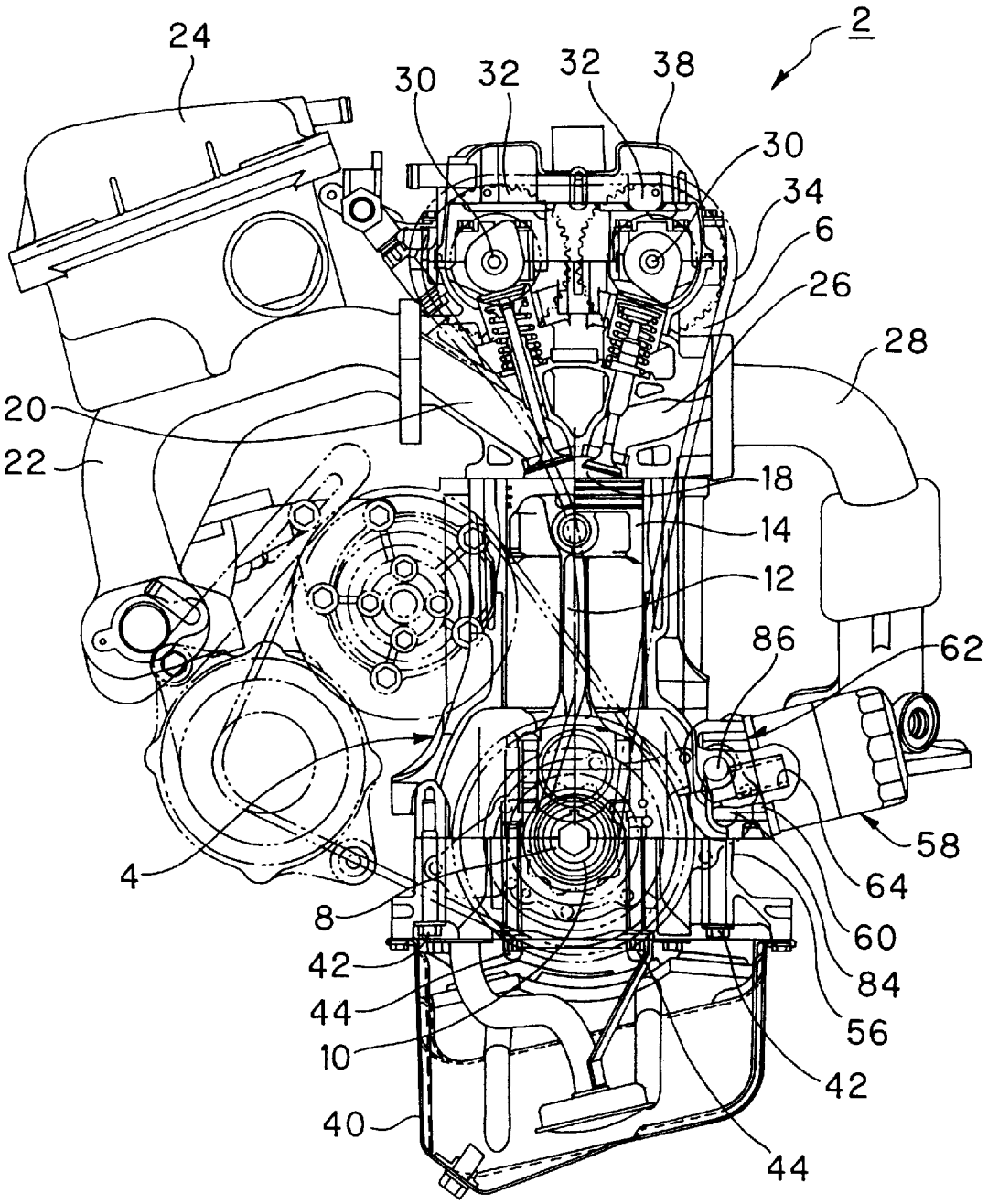
FIG. 2 is a cross-sectional view showing an engine.
Figure 3:
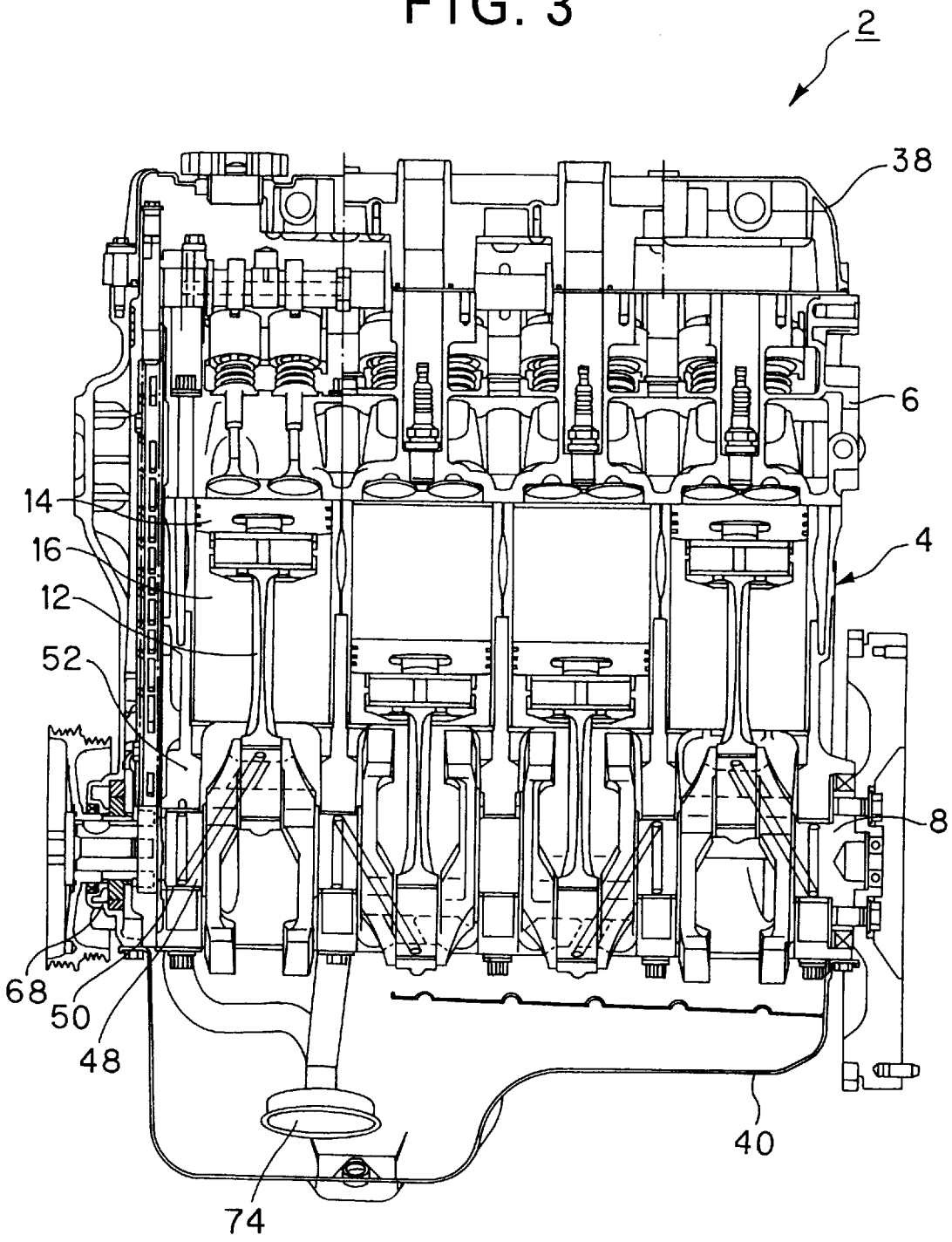
FIG. 3 is a longitudinal cross-sectional view showing the engine.
Figure 4:
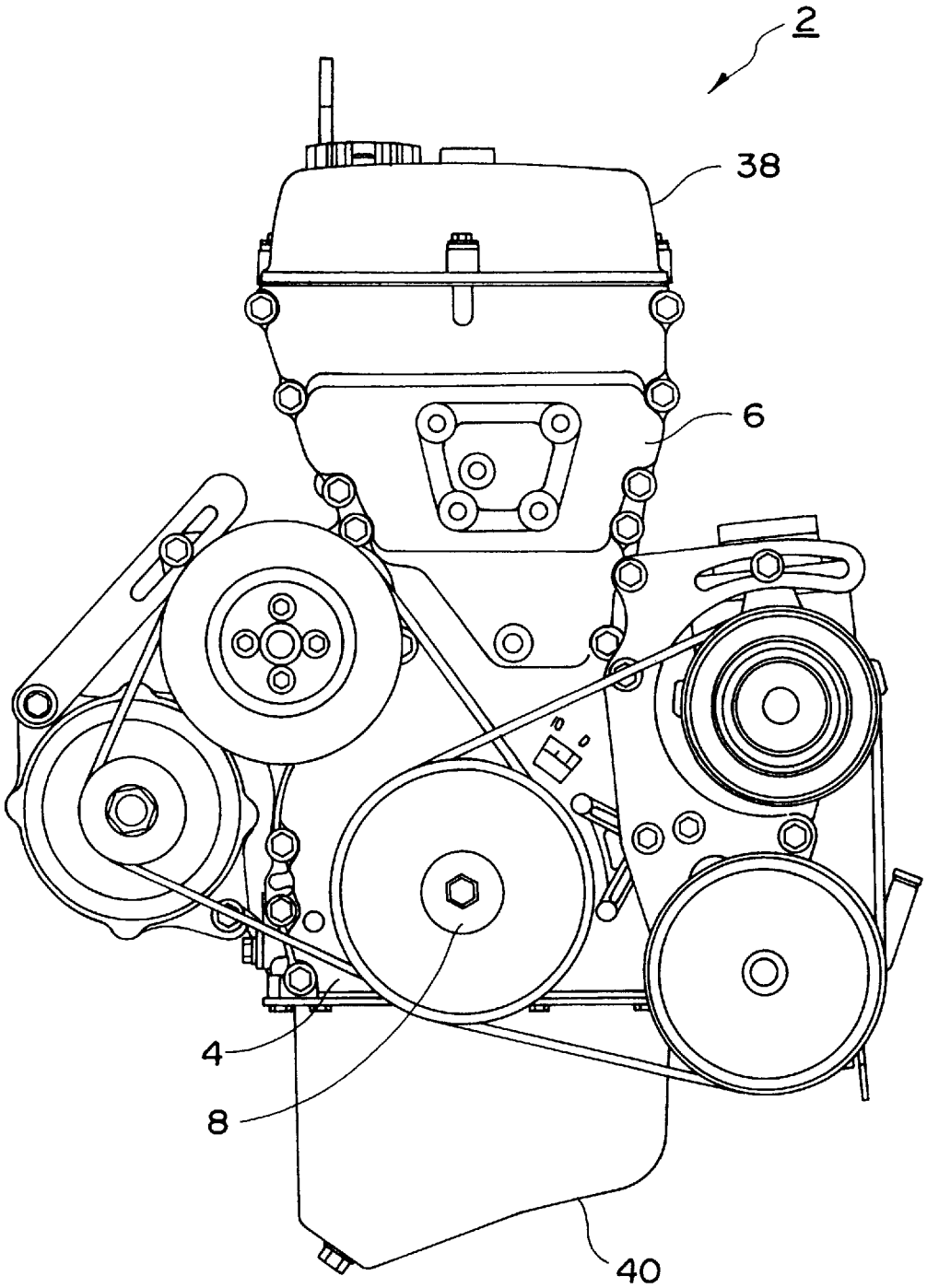
FIG. 4 is a front view showing the engine.
Figure 5:
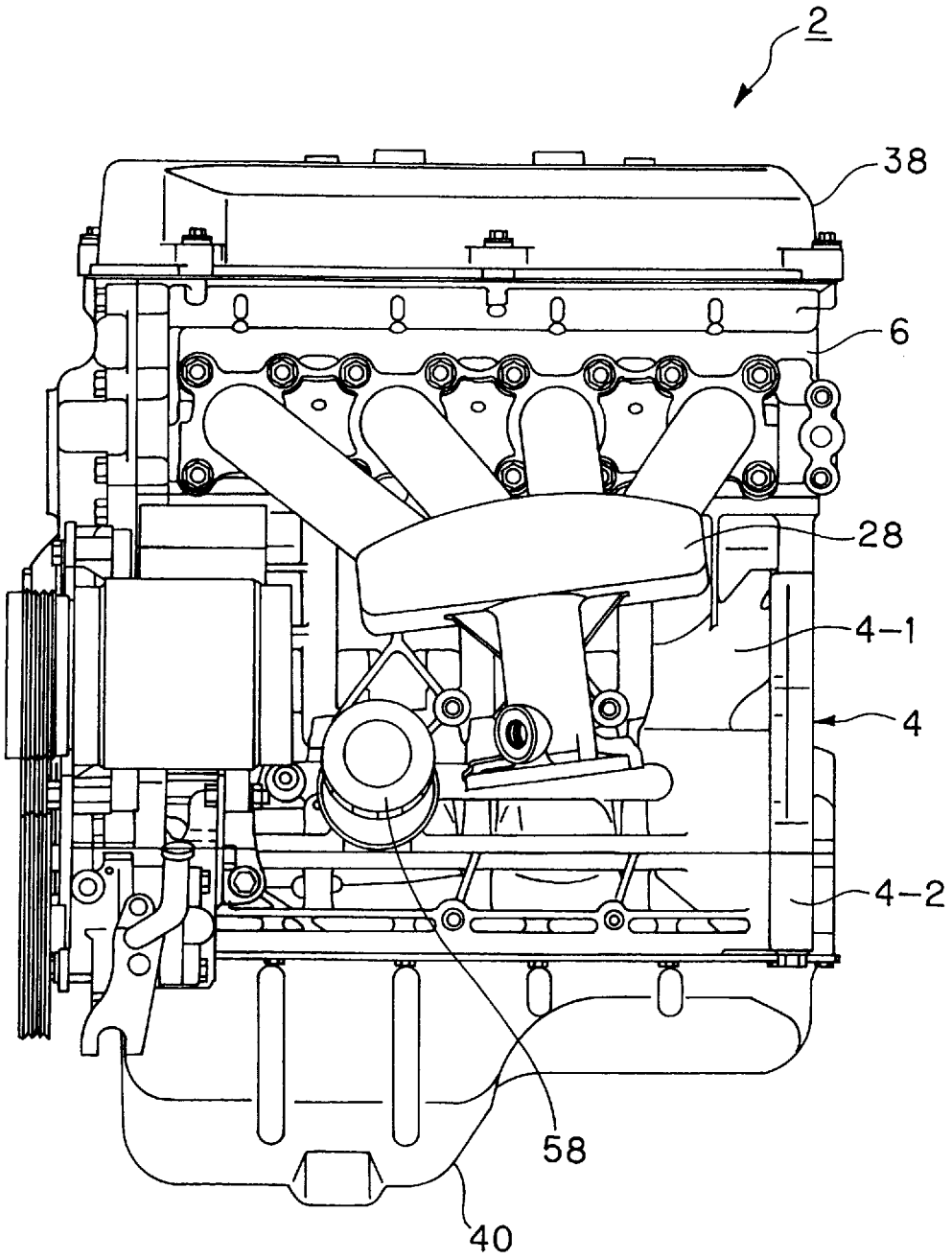
FIG. 5 is a side view showing the engine.

Embodiments of the present invention will now be described in detail with reference to the drawings, wherein FIGS. 1–36 illustrates a first embodiment.

In FIGS. 1–6, reference numeral 2 denotes an engine; 4 a cylinder block; 6 a cylinder head; 8 a crankshaft; 10 a crankshaft sprocket; 12 a connecting rod; 14 a piston; 16 a cylinder; 18 a combustion chamber; 20 an intake port; 22 an intake manifold; 24 an air cleaner; 26 an exhaust port; 28 an exhaust manifold; 30 a camshaft; 32 a camshaft sprocket; 34 a timing chain; 36 a chain adjuster; 38 a cylinder head cover; and, 40 an oil pan.

Turning now to the cylinder block 4, it is formed by a half-skirted cylinder block 4-1 and a block lower case 4-2 which are fixedly joined by several tightening bolts 42 and housing bolts 44. To this end, the cylinder block 4 is formed with spot facings 46 for the housing bolts 44.

The crankshaft 8 is supported at a journal portion 48 (FIG. 3) thereof by a journal housing section 52 of the cylinder block 4 through a journal metal or sleeve 50.

Figure 7:
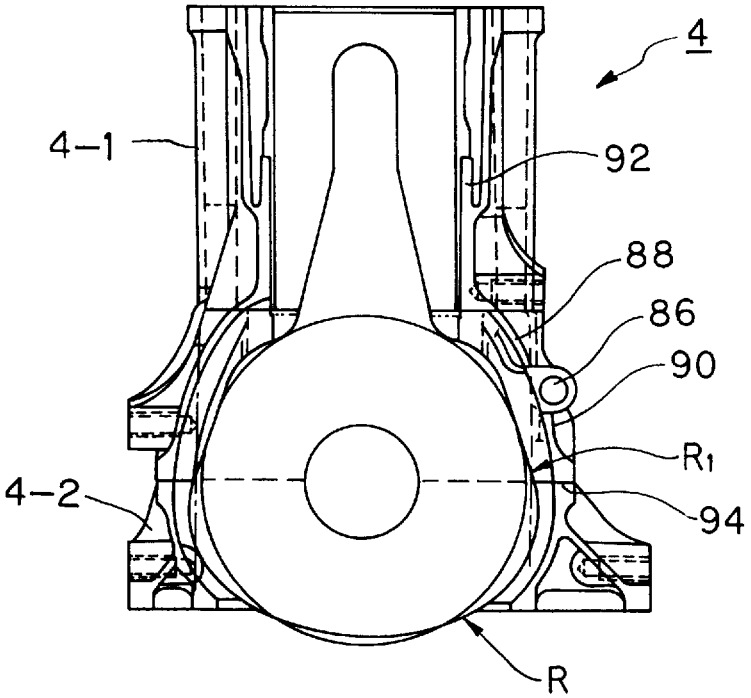
FIG. 7 is an illustration showing a rod locus of a connecting rod in a parting type of cylinder block.
Figure 8:
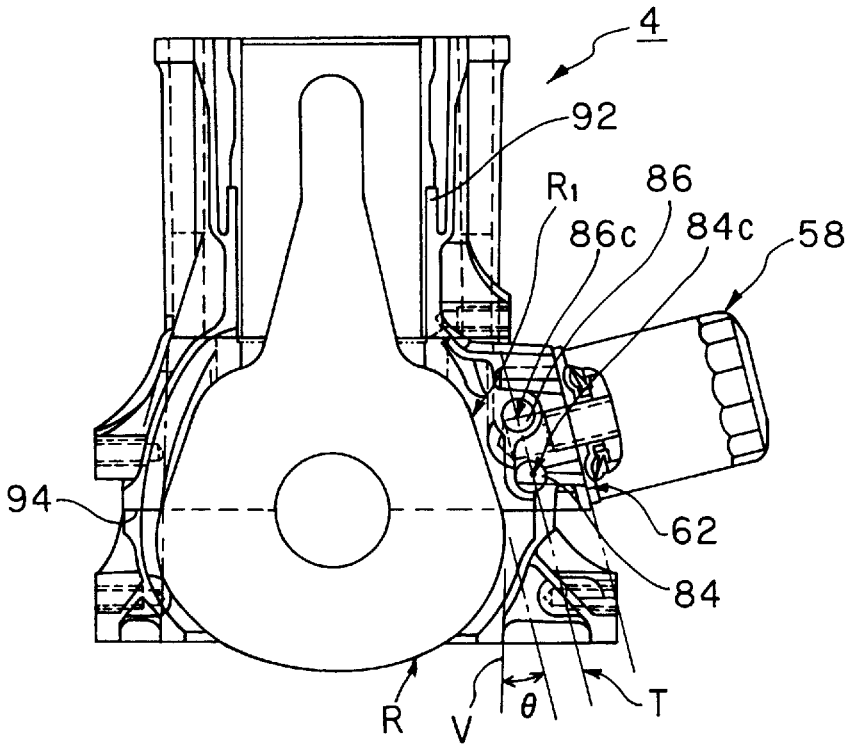
FIG. 8 is an illustration shown the rod locus in the parting type of cylinder block having an oil filter thereon.
Figure 9:
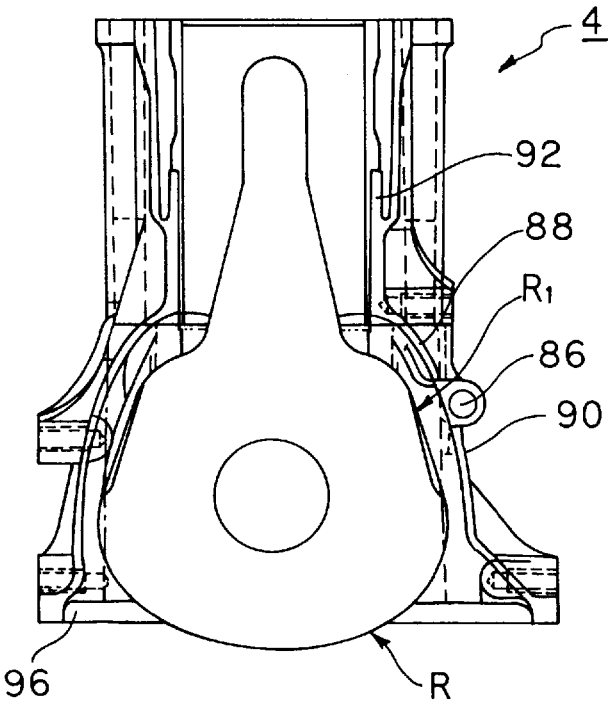
FIG. 9 is an illustration showing a rod locus of a connecting rod in a deep sleeve type of one-piece cylinder block.
Figure 10:
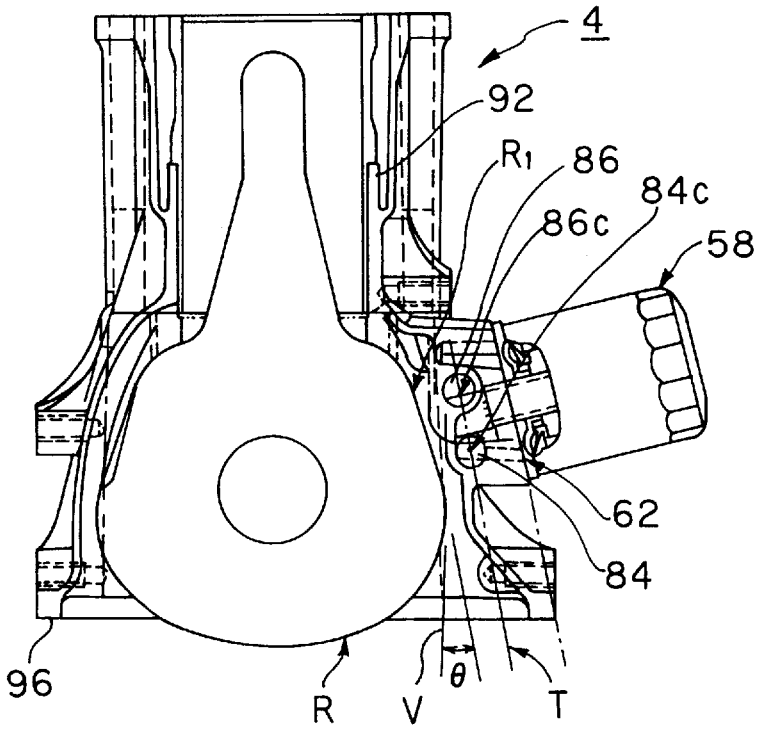
FIG. 10 is an illustration showing the rod locus in the aforesaid one-piece cylinder block, which cylinder block has an oil filter disposed thereon.

Referring to FIGS. 7, 8 or FIGS. 9, 10, rotation of the crankshaft 8 drives the connecting rod 12 creating the rod locus "R". In this rod locus "R", sideways linear locus portion "$R_1$" is drawn at angle θ with respect to vertical line "V". Note that the cylinder block 4 in FIGS. 7 and 8 is formed by the half-skirted cylinder block 4-1 and the block lower case 4-2, whereas the cylinder block 4 in FIGS. 9 and 10 is of a deep-skirted one-piece structure.

The piston 14 is reciprocably supported in the cylinder 16 on a sleeve 54.

Figure 24:
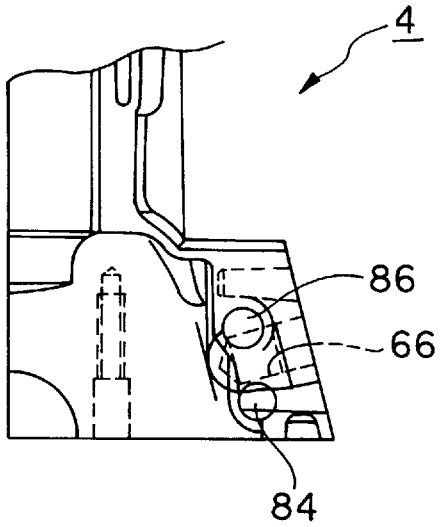
FIG. 24 is a partial cross-sectional view showing a cylinder block.
Figure 25:
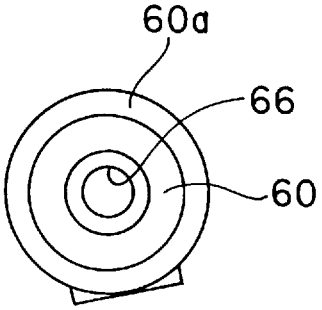
FIG. 25 is a front view showing a filer-mounting surface.
Figure 26:
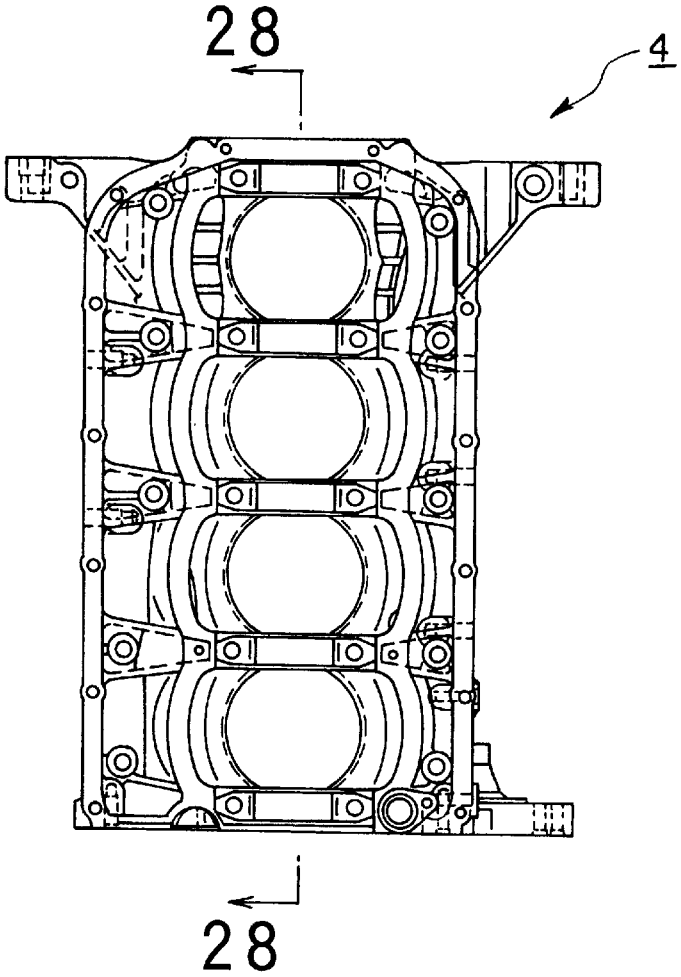
FIG. 26 is a bottom view illustrating the parting type of cylinder block.
Figure 27:
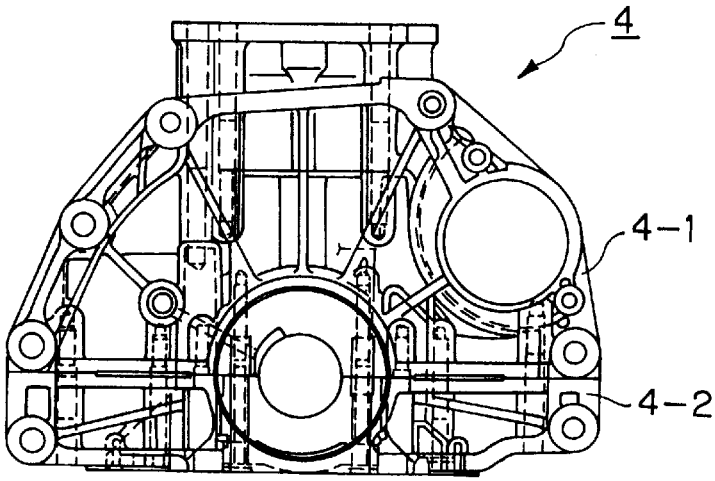
FIG. 27 is a front view illustrating the cylinder block of FIG. 26.
Figure 28:
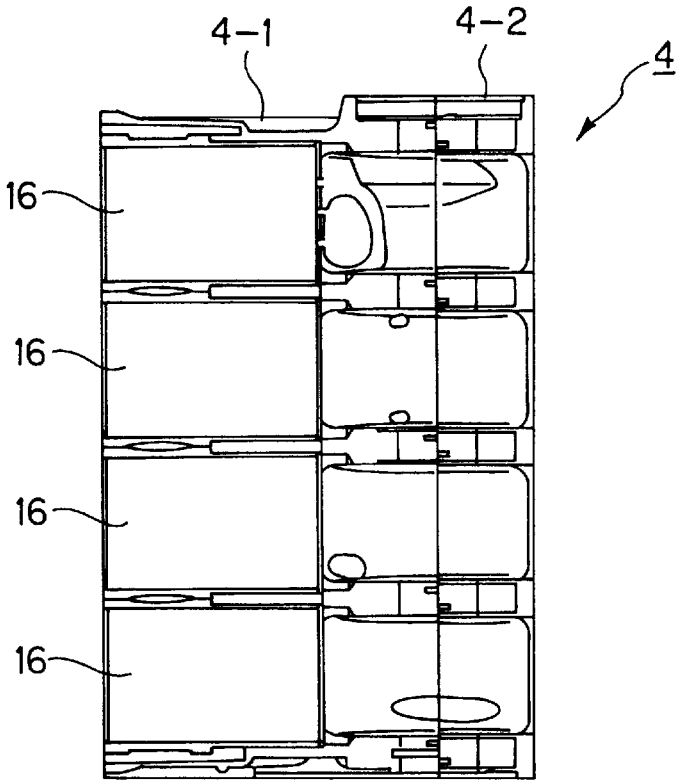
FIG. 28 is a cross-sectional view illustrating the cylinder block taken along line 28—28 of FIG. 26.
Figure 29:
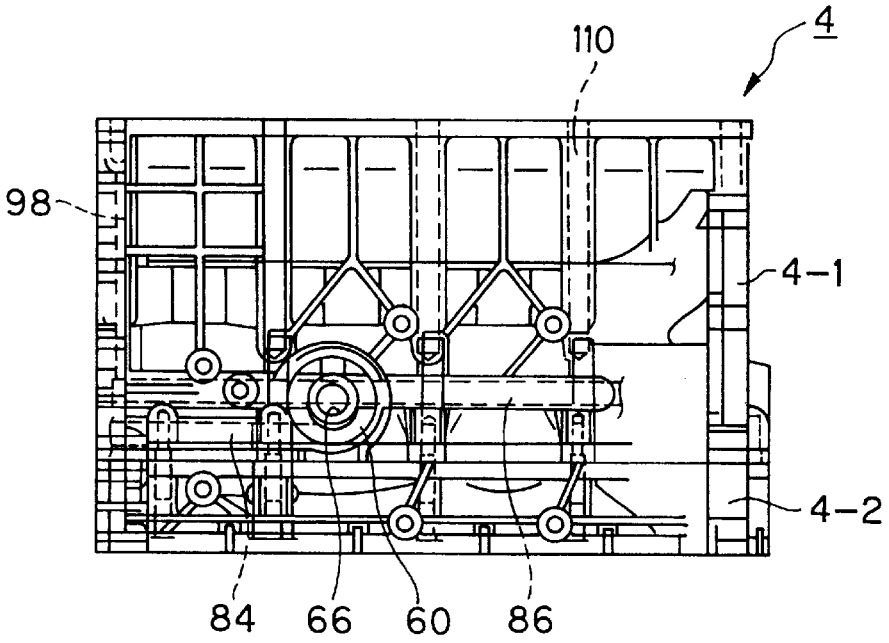
FIG. 29 is a side view showing the cylinder block of FIG. 27.
Figure 30:
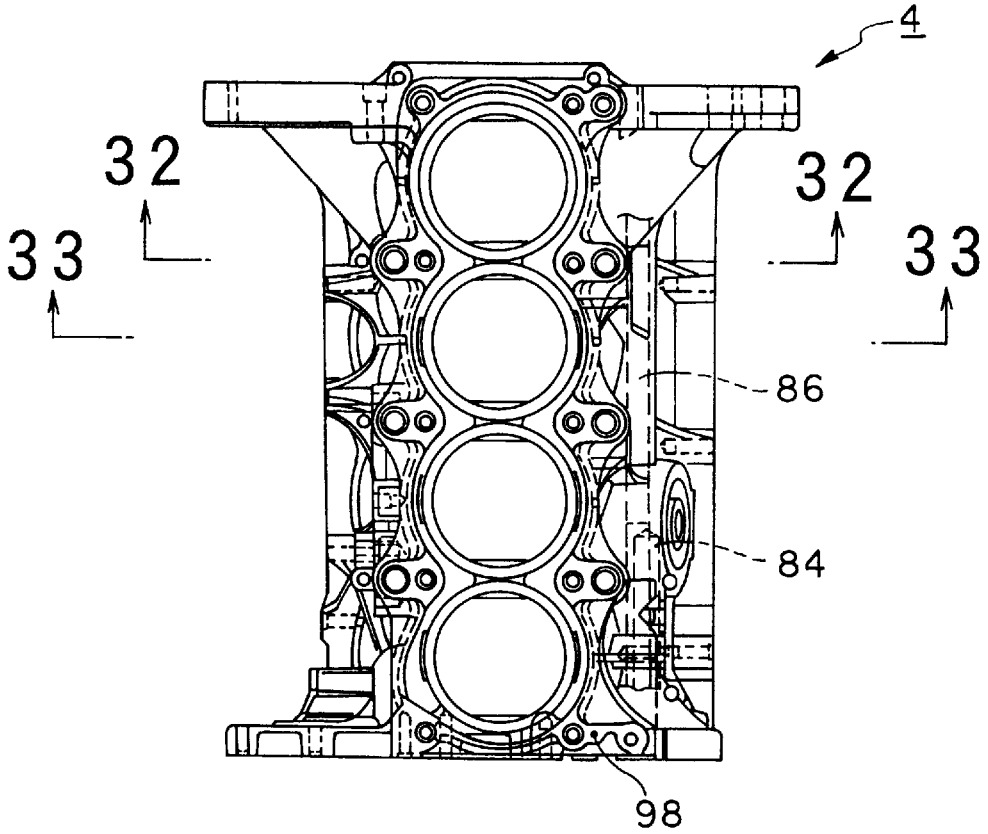
FIG. 30 is a plan view illustrating the parting type of cylinder block.
Figure 31:
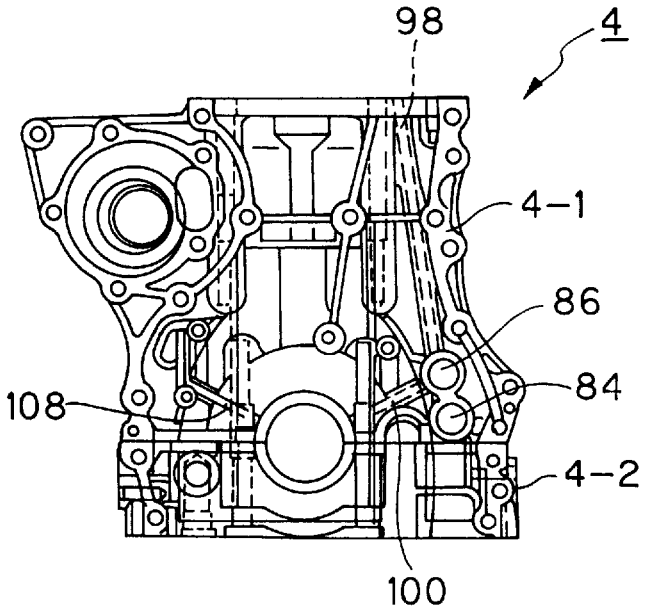
FIG. 31 is a front view illustrating the parting type of cylinder block of FIG. 30.
Figure 32:
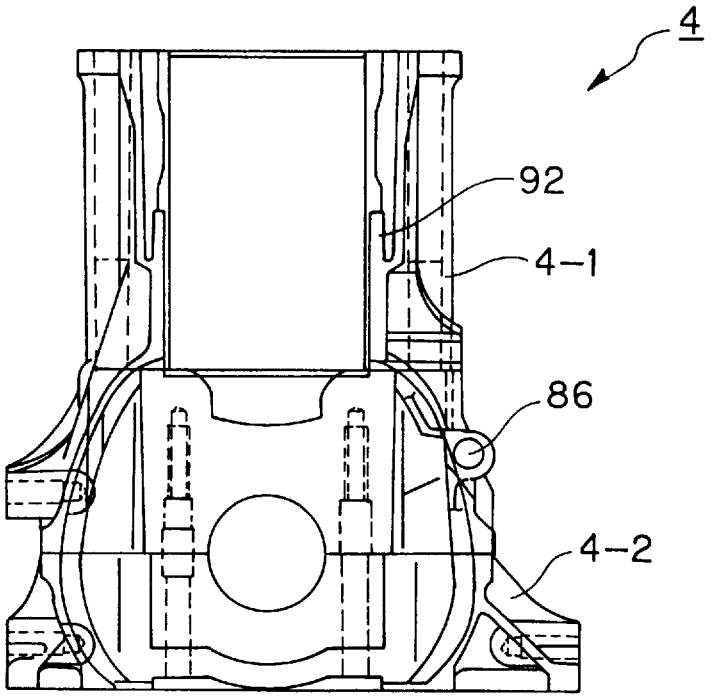
FIG. 32 is a cross-sectional view showing the cylinder block taken along line 32—32 of FIG. 30.
Figure 33:
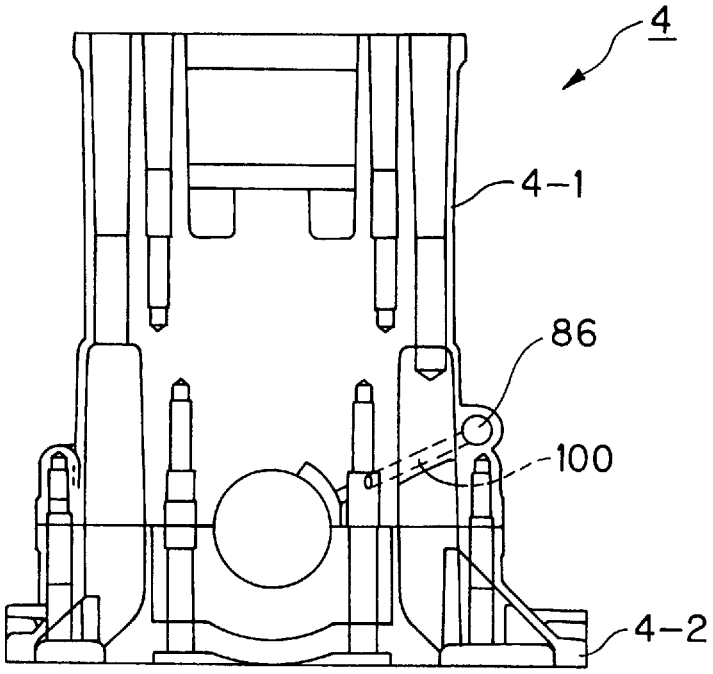
FIG. 33 is a cross-sectional view showing the cylinder block taken along line 33—33 of FIG. 30.
Figure 34:
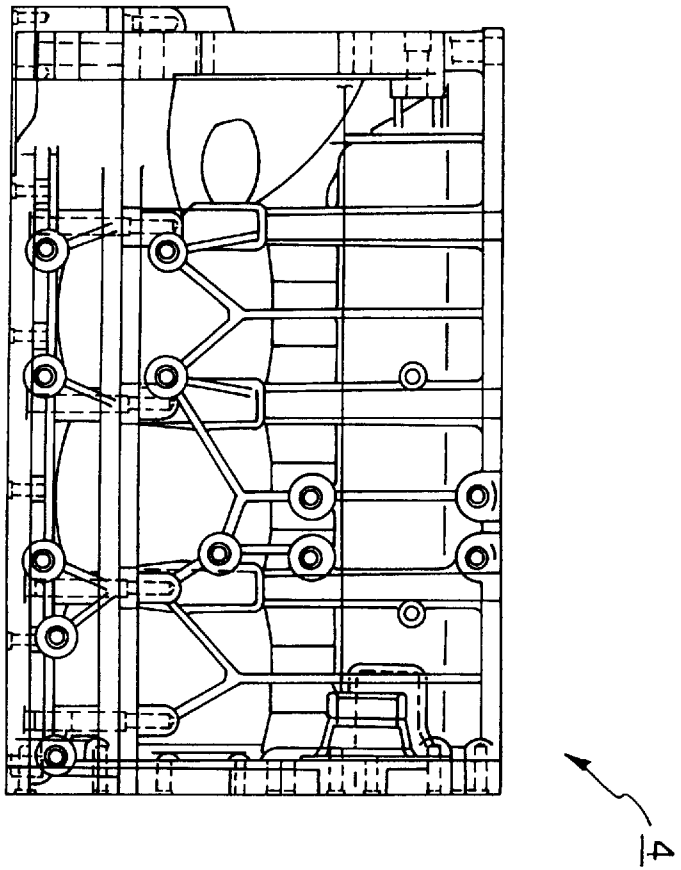
FIG. 34 is a side view illustrating the cylinder block of FIG. 31.

An oil filter 58 is mounted on an outer portion 56 of the cylinder block 4. The oil filter 58 is mounted on a filter-mounting surface 62 through a filter stand 64. The filter-mounting surface 62 is formed at a filter-mounting portion 60 of the outer portion 56 substantially parallel to the aforesaid locus portion "$R_1$". To this end, the filter-mounting surface 62 is formed with a hole 66 for fixing the filter stand 64 thereon. In addition, the filter-mounting portion 60 is defined with a filter-sealing surface 60*a* (FIG. 24).

A trochoidal oil pump 68 (FIGS. 1 and 3) is mounted on the crankshaft 8. The pump 68 includes an inner rotor 70 and an outer rotor 72, and is designed to draw in oil from the oil pan 40 (FIG. 2) through an intake-side port 78 past both an oil strainer 74 and an intake-side oil passage 76, and then to discharge the oil from a discharge-side port 80. the intake-side oil passage 76 is formed in the cylinder block 4.

The cylinder block 4 has a relieve valve 82 provided at the discharge-side port 80 for regulating the pressure of the oil which is fed under pressure from the oil pump 68.

The cylinder block 4 is further provided with a sub-gallery 84. The sub-gallery 84 is communicated to the discharge-side portion 80 so as to cause the oil fed under pressure from the oil pump 68 to be guided to the oil filter 58.

In addition, the cylinder block 4 is formed with a main gallery 86. The main gallery 86 is positioned near the sub-gallery 84 for guiding and distributing the oil from the oil filter 58 into each section of the engine 2. As illustrated in FIGS. 8 and 10, a line "T" which connects the center 86*c* of the main gallery 86 with the center 84*c* of the sub-gallery 84 is positioned substantially parallel to locus portion "$R_1$" and/or the filter-mounting surface 62.

It is acceptable that any ones of the aforesaid locus portion "$R_1$", filter-mounting surface 62, and gallery-connecting line "T" are arranged substantially parallel to one another.

The main gallery 86 is positioned so as to be closely attached to an arcuate skirt surface 90 at a skirt portion 88 of the cylinder block 4. In addition, the main gallery 86 is provided substantially midway along the skirt portion 88 at a position spaced apart from both the piston support sleeve 54 and a sleeve portion 92 which press-fits the sleeve 54. In the cylinder block 4 with two parting sections, the main gallery 86 is largely spaced apart from a case-mating surface 94 of the block lower case 4-2. In the deep-skirted cylinder block 4, the main gallery 86 is formed and isolated from an oil pan-mating surface 96 of the oil pan 40. The main gallery 86 is confined or closed at its front and rear ends 86*a* and 86*b* by means of either blind taps (i.e. plugs) 86*a* or other components such as an oil pump case.

The sub-gallery 84 is formed adjacent to the aforesaid case-mating surface 94. The case-mating surface 94 below the sub-gallery 84 is positioned offset, or rather displaced in an outward direction of the sub-gallery 84 (see FIG. 11).

A head-side oil passage 98 is communicated to the main gallery 86. As seen from FIG. 1, the oil passage 98 is directed upward, and is opened to an upper surface 4*a* of the cylinder block 4.

In addition, a journal-side oil passage 100 is communicated to the main gallery 86. The passage 100 is oriented to communicate with the journal portion 48 of the crankshaft 8. In other words, the oil passage 100 is at a downward slant toward the left side in FIG. 1. The main gallery 86 is provided with an opening of the journal-side oil passage 100 so as to avoid an opening of the head-side oil passage 98. In addition, the journal-side passages 100 are formed along a reinforcing rib-shaped portion 102 which extends sideways from the journal housing section 52 in the form of a skirt (see FIGS. 1 and 36).

Figure 22:
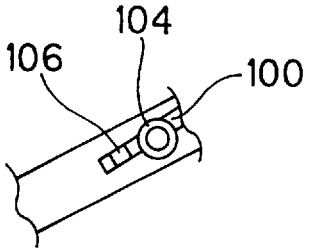
FIG. 22 is a partial cross-sectional view showing the cylinder block of FIG. 19.
Figure 23:
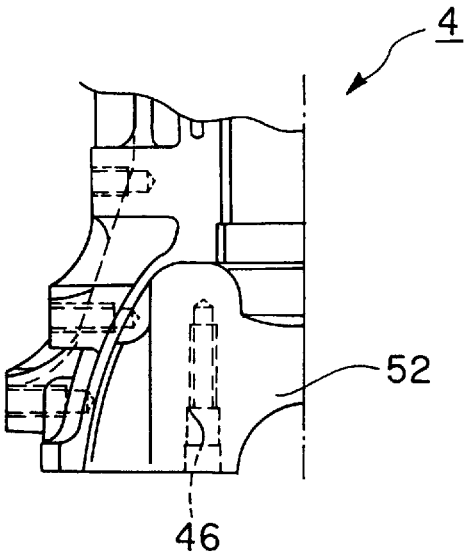
FIG. 23 is a cross-sectional view illustrating the cylinder block taken along line 23—23 of FIG. 17.

Referring now to FIG. 22, the journal-side oil passage 100 is shown communicated to a housing-side oil passage 104. The latter passage 104 is formed by the use of the spot facings 46 of the housing bolts 44. As illustrated in FIG. 1, the housing-side oil passage 104 is communicated to a metal-side oil passage 106. The metal-side oil passage 106 is formed in the journal housing section 52 at the rear of a journal metal or sleeve 50.

Figure 6:
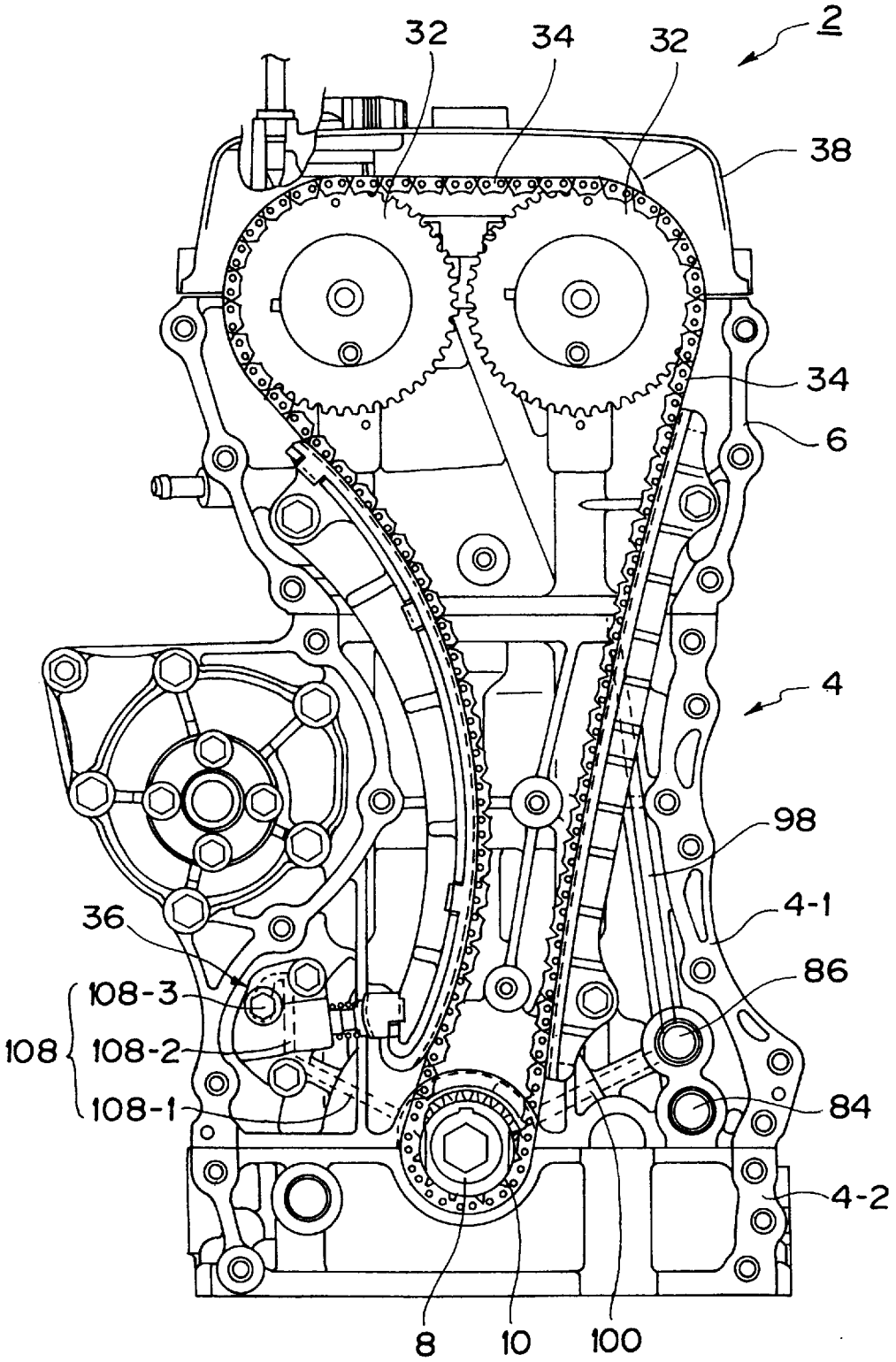
FIG. 6 is a partial front view showing the engine.

As illustrated in FIGS. 1 and 6, the metal-side oil passage 106 is communicated to a chain adjuster-side oil passage 108 for introducing the oil into the chain adjuster 32. The chain adjuster-side oil passage 108 consists of: a first chain adjuster-side oil passage 108-1 communicated to the metal-side oil passage 106; a second chain adjuster-side oil passage 108-2 communicated to the first passage 108-1; and, a chain oil suction hole 108-3 communicated to the second passage 108-2. These passages are provided in the cylinder block 4.

Figure 13:
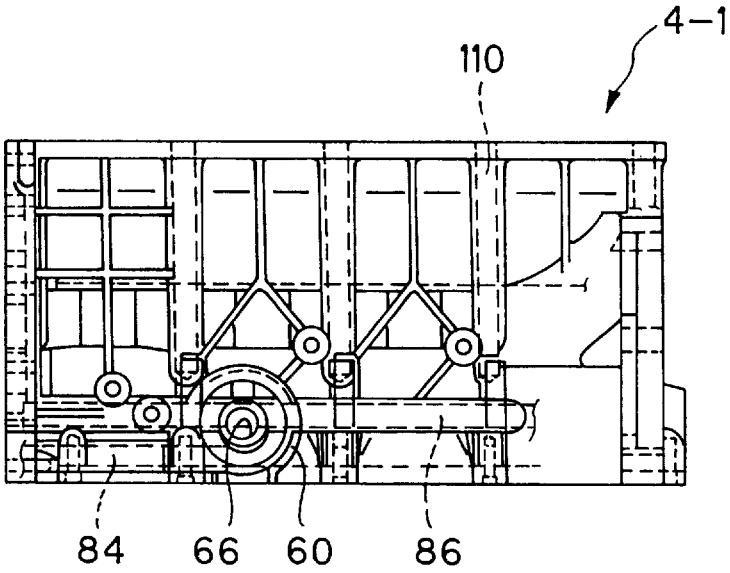
FIG. 13 is a side view showing the cylinder block of FIG. 12.
Figure 14:
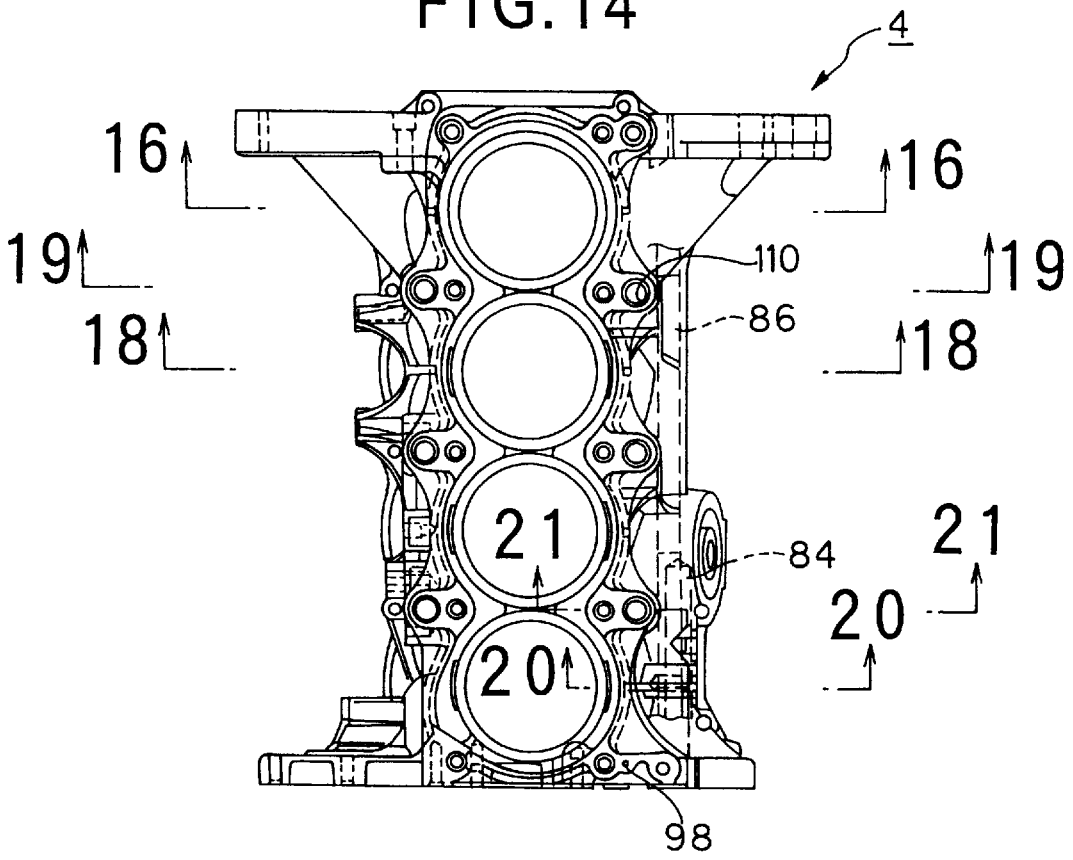
FIG. 14 is a plan view illustrating a cylinder block.
Figure 15:
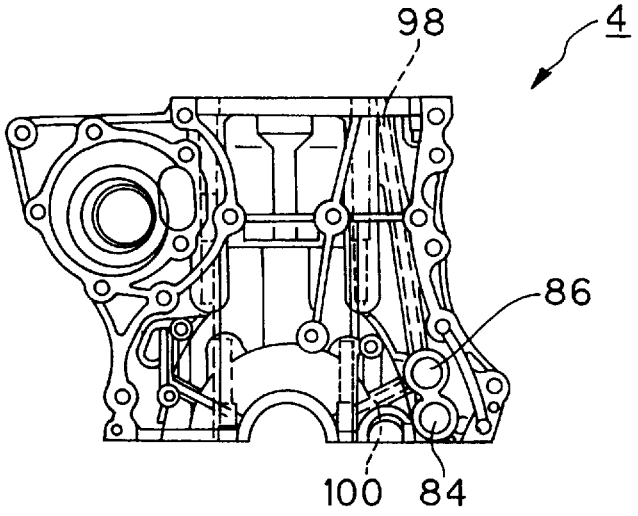
FIG. 15 is a front view illustrating the cylinder block of FIG. 14.
Figure 16:
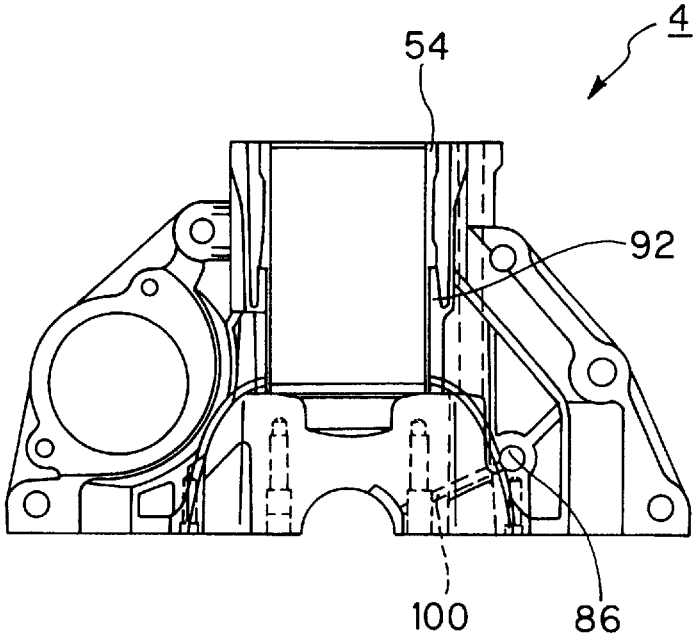
FIG. 16 is a cross-sectional view showing the cylinder block taken along line 16—16 of FIG. 14.
Figure 17:
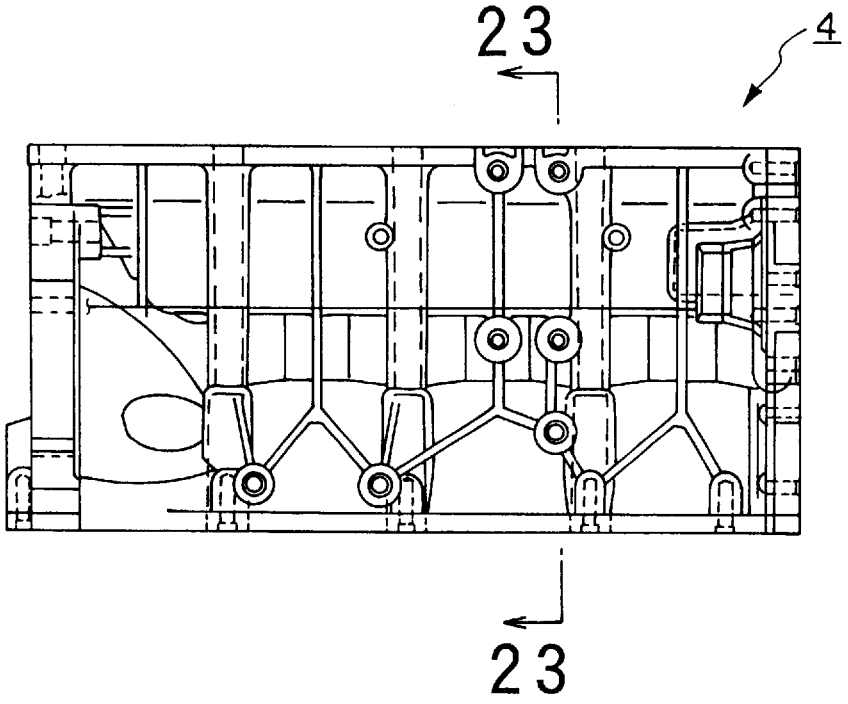
FIG. 17 is a side view showing the cylinder block of FIG. 16.
Figure 18:
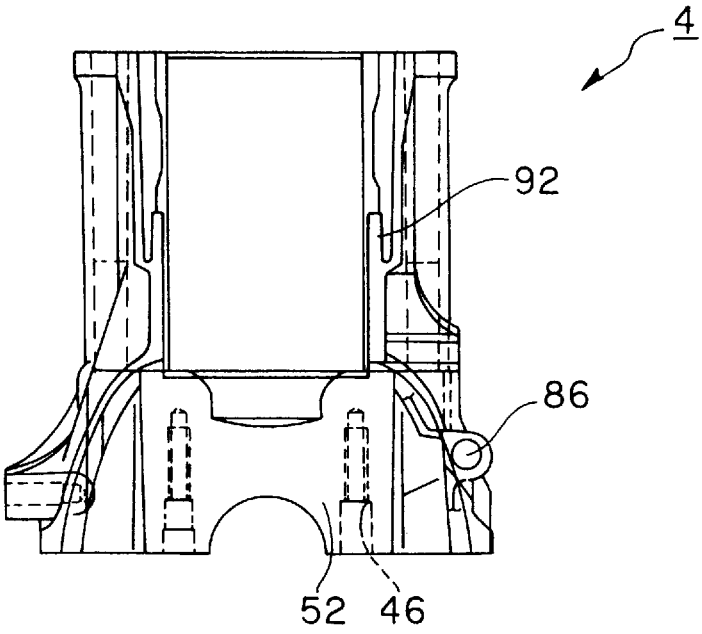
FIG. 18 is a cross-sectional view showing the cylinder block taken along line 18—18 of FIG. 14.
Figure 19:
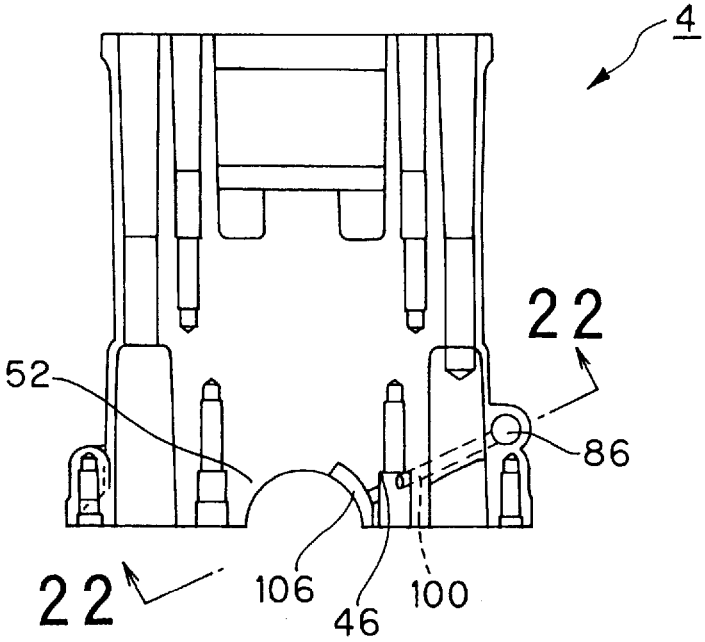
FIG. 19 is a cross-sectional view of the cylinder block taken along line 19—19 of FIG. 14.
Figure 20:
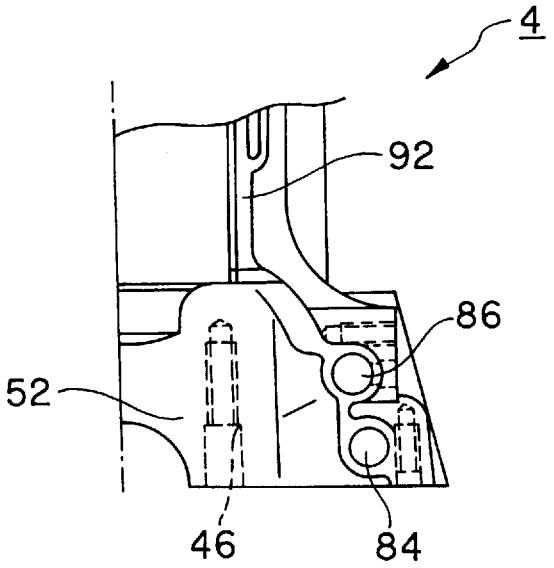
FIG. 20 is a cross-sectional view illustrating the cylinder block taken along line 20—20 of FIG. 14.
Figure 21:
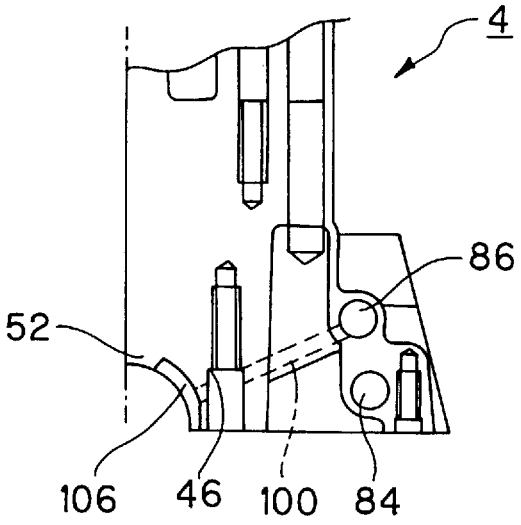
FIG. 21 is a cross-sectional view illustrating the cylinder block taken along line 21—21 of FIG. 14.

Reference numeral 110 in FIG. 13 denotes a blow-by gas passage.

Next, the operation of the above embodiment will be described.

When the crankshaft 8 is brought into rotation by driving of the engine 2, then the oil pump 68 is actuated to blow the oil in the oil pan 40 into the intake-side port 78 through both of the oil strainer 74 and the intake-side port 76. The oil is then fed under pressure by the oil pump 68 into the sub-gallery 84 through the discharge-side port 80. Thereafter, the oil is caused to flow into the oil filter 58.

The oil is filtered by the oil filter 58. The filtered oil is then delivered to the head-side oil passage 98 through both of the stand hole 66 and the main gallery 86, and is thereafter supplied to the cylinder head 6. Further, the oil is supplied to the journal portion 48 of the crankshaft 8 after being delivered from main gallery 86 through the journal-side oil passage 100, the housing-side oil passage 104, and the metal-side oil passage 106. Meanwhile, the oil is supplied to the chain adjuster 36 through both of the metal-side oil passage 106 and the chain adjuster-side oil passage 108.

In the first embodiment, as described above, the sub-gallery 84 and the main gallery 86 are positioned closely adjacent to one another. In addition, the head-side oil passage 98 is communicated to the main gallery 86 in a state of being directed upward so as to reach the upper surface 4*a* of the cylinder block 4. Rather, the journal-side oil passage 100 is communicated to the main gallery 86 in a state of being inclined toward the journal portion 48. Such a construction eliminates blind taps or plugs for use in the oil passages other than the main gallery 86. This results in fewer processes of working the oil passages which are led to the cylinder block 4. Further, quite a few blind taps or plugs are eliminated, thereby providing reductions in cost and weight, and reduction in component-assembling cost. In addition, it is possible to shorten the overall lengths of the oil passages, to reduce oil pressure loss, and to improve the lubricating function. With further reference to FIGS. 1 and 6, the overall lengths of the oil passages, which are led to the chain adjuster 36, can be made shorter, and the oil can be directly supplied to the chain adjuster 36 immediately after the engine 2 starts up. This feature makes it possible to bring the chain adjuster 36 into satisfactory action immediately after start-up of the engine 2, and to reduce the occurrence of adjustment operation-caused noise at the time of start-up of the engine 2.

The main gallery 86 is closely fitted to the arcuate skirt surface 90 of the skirt portion 88. The main gallery 86 is spaced apart from the sleeve 54 and the press-fit sleeve portion 92. The main gallery 86 is formed substantially along the skirt portion 88. In addition, the main gallery 86 is spaced apart from either the case-mating surface 94 of the block lower case 4-2 or the oil pan-mating surface 96 of the oil pan 40. Further, any ones of the filter-mounting surface 62, sideways linear locus portion "$R_1$", and gallery-connection line "T" are arranged substantially parallel to one another. Then, the skirt portion 88 is reinforced by the main gallery 86 so as to be combined together at the front and rear thereof. As a result, improved rigidity of the skirt portion 88 and reduced vibration and noise are achievable. Further, conventionally there is a possibility that the main gallery 86 and one of the under-mentioned neighboring sections are communicated to one another through the metal porosity, resulting in a rejected cylinder block, when the main gallery 86 is positioned near any one of the following sections: a cast portion of the sleeve 54; a machined surface for press-fit of the sleeve 54; the case-mating surface 94 of the block lower case 4-2 of the cylinder block 4; and the oil pan-mating surface 96 of the oil pan. Meanwhile, the first embodiment obviates such a likelihood, and the rate of rejection in manufacturing of the cylinder block 4 can be greatly reduced. In addition, an impregnation process, which has conventionally been required in order to cope with such rejection due to the porosity, is eliminated. As a result, fewer working processes and lower costs are achievable.

Figure 11:
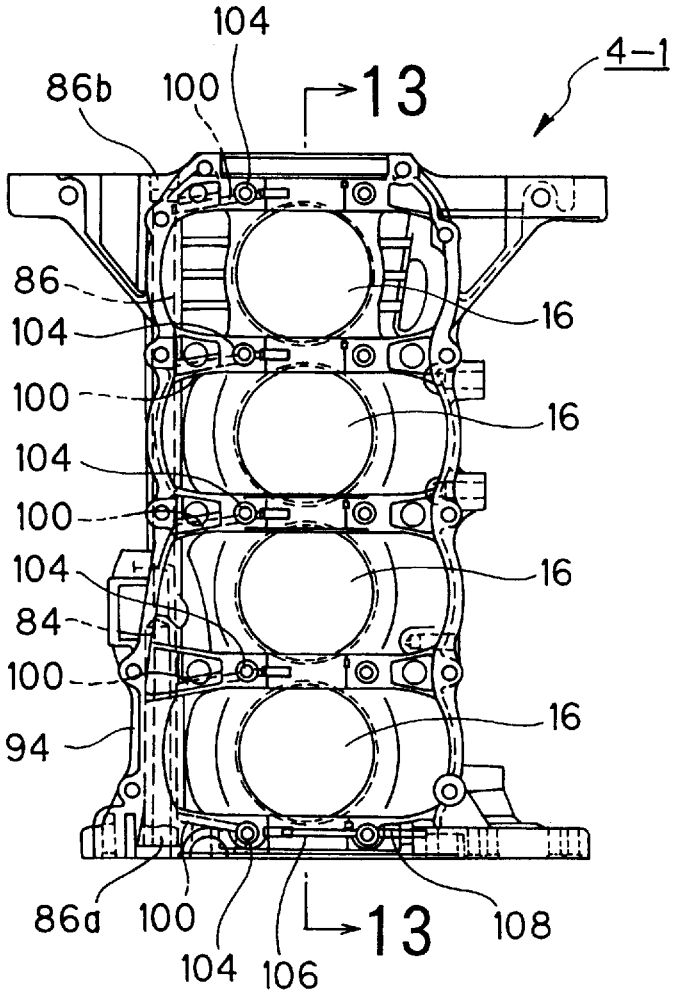
FIG. 11 is a plan view illustrating a half skirt type of cylinder block.
Figure 12:
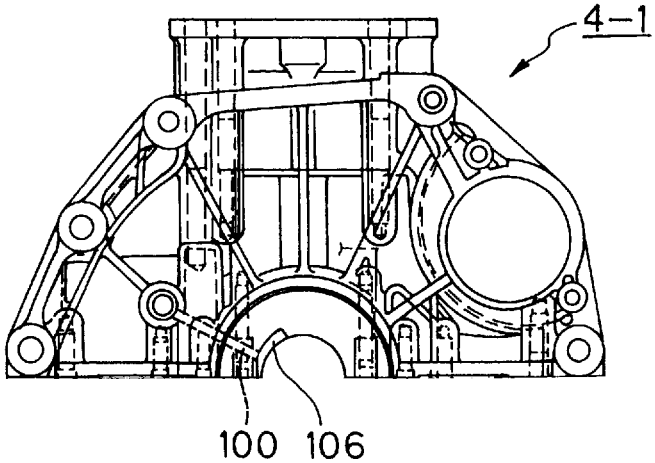
FIG. 12 is a front view illustrating the cylinder block of FIG. 11.

The cylinder block 4 includes the half-skirted cylinder block 4-1 as an upper section and the block lower case 4-2 as a lower section. As illustrated in FIGS. 8 and 11, the sub-gallery 84 is formed adjacent to the case-mating surface 94 of the block lower case 4-1; and, the case-mating surface 94 below the sub-gallery 84 is provided offset in an outward direction of the sub-gallery 84. As a result, the main gallery 86, the sub-gallery 84, and the oil filter 58 can be arranged near the center of the engine 2 relative to the longitudinal extent thereof. The cylinder block 4 is thereby made compact and light-weighted, with a consequential reduction in cost. In addition, since the oil filter 58 can be slanted and positioned close to the center of the engine 2 along the longitudinal length thereof, then the entire engine 2 including the oil filter 58 can be rendered compact. Consequently, the loadability of the engine 2 into an engine compartment is improved; a greater amount of freedom is provided with respect to an angle at which the engine 2 is disposed; and, in quite a few vehicles, the engine 2 can be disposed therein without the use of a filter adapter and the like. In addition, the filter-mounting portion 60, the main gallery 86, and the sub-gallery 84 can be positioned close to each other. Further, the oil passages can be formed by means of fewer machined holes.

Further, since the journal-side oil passage 100 is formed in the cylinder block 4 so as to avoid the head-side oil passage 98, then the tightening bolts 42 of the block lower case 4-2 can be laid out on the case-mating surface 94 of the block lower case 4-2 below the sub-gallery 84, with a consequential improvement in sealing performance.

Moreover, the journal-side oil passage 100 is provided in a state of being slanted toward the journal portion 48 from the main gallery 86, when viewed from below, so as to avoid the head-side oil passage 98. Accordingly, a passage, to which the oil drops from the cylinder head 6, can be formed in a sideways direction of the journal housing section 52. In addition, the journal-side oil passages 100 are formed in the cylinder block 4 along the reinforcing rib-shaped portion 102 which extends in the form of a skirt in the sideways direction of the journal housing section 52. Accordingly, the rib shaped extending in the sideways direction of the journal housing section 52 can further be reinforced. As a result, vibration and noise can be reduced.

Figure 35:
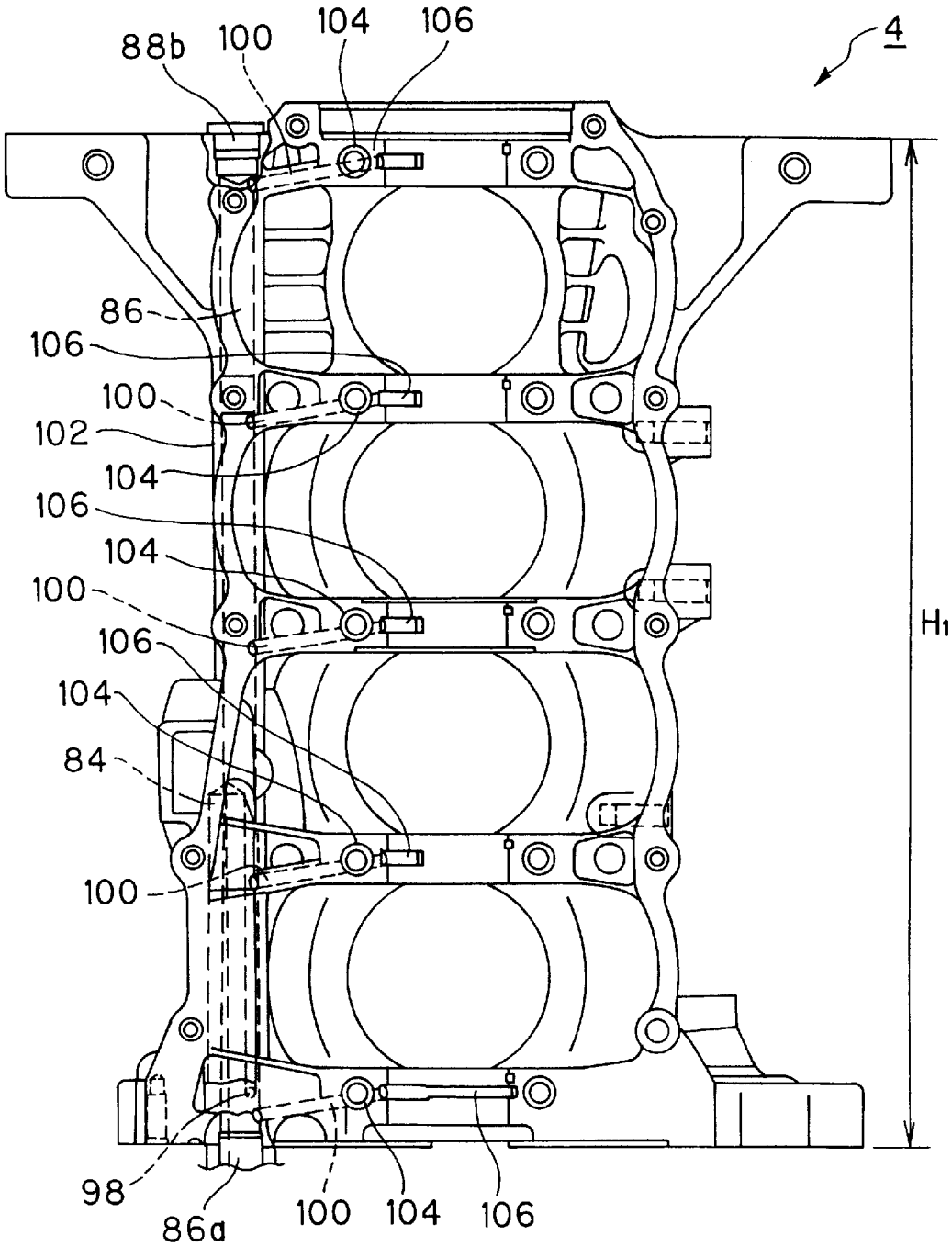
FIG. 35 is a plan view showing a cylinder block.
Figure 36:
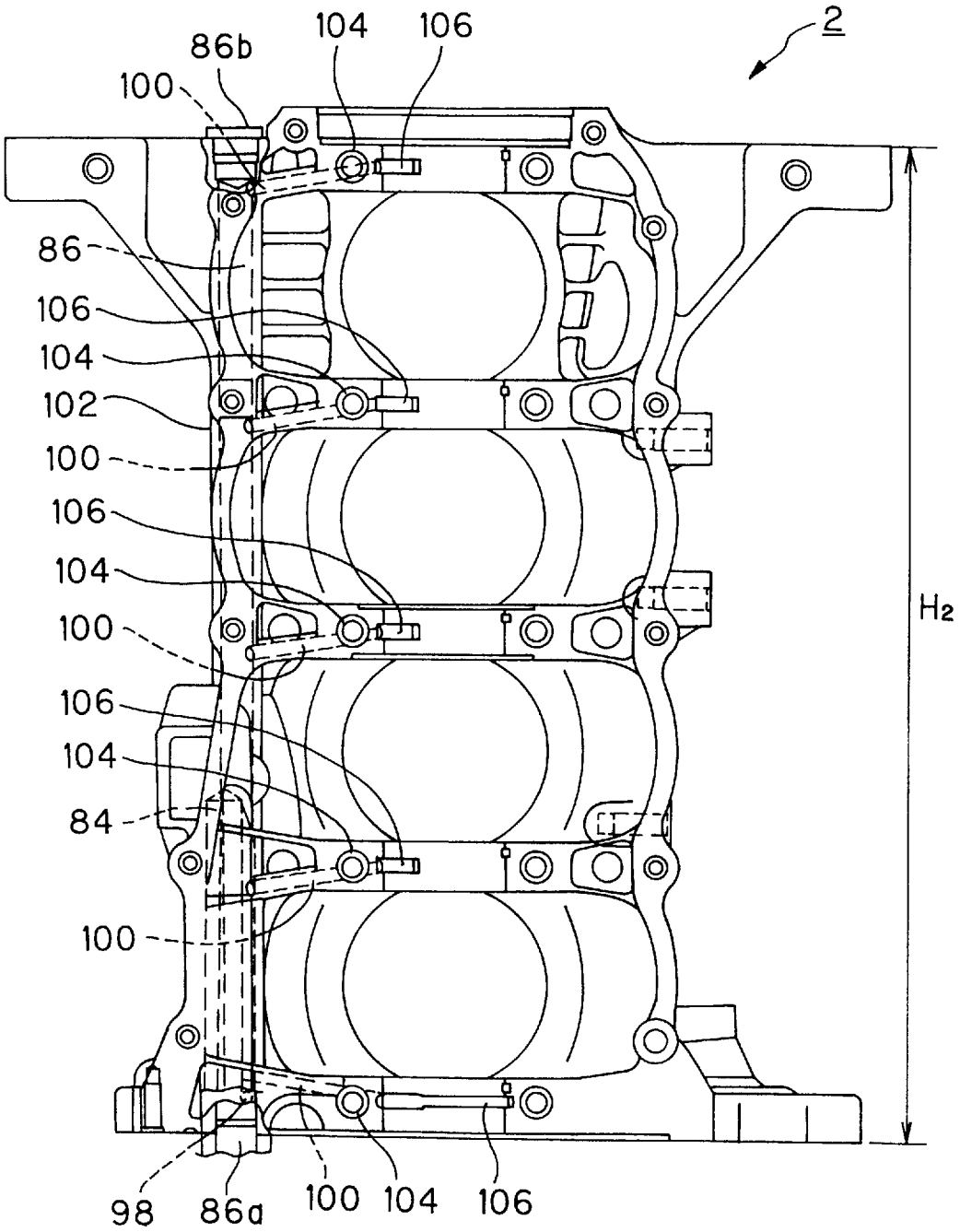
FIG. 36 is a plan view showing a cylinder block having a shorter overall length.

As illustrated in FIGS. 35 and 36, respective passages at the foremost and rearmost ends of the journal-side oil passage 100 which reaches the journal portion 48 from the main gallery 86 are slanted in opposite directions when seen from below the engine 2. Such a structure enables easy formation of components such as the blind plugs at the front and rear ends of the main gallery 86, and enables a decrease in the distance between such components as the aforesaid blind plugs. Accordingly, the length of the engine 2 in a longitudinal direction thereof is reduced, thereby providing the compact and light-weighted engine 2 at lower cost, with a consequential improvement in the mounting of the engine 2 into a vehicle. Further, since the main gallery 86 is made smaller in length, it is possible to reduce the number of movable pins at the time of casting, thereby realizing an improvement in castability due to a reduction in the pin length. In addition, enhanced workability can be realized through a reduction in the length of a gun drill for use in trimming. Moreover, all of the journal-side oil passages 100 are positioned offset so as to be directed in the same direction toward the blind plug 86*a* in FIG. 35, while, as illustrated in FIG. 36, only one of the journal-side oil passages 100, which is closest to the blind plug 86*a*, is deviated so as to be directed toward the opposite blind plug 86*b*, with the remaining oil passages 100 being oriented toward the blind plug 86*a*. Then, overall length "$H_2$" of the cylinder block 4 in FIG. 36 can be made slightly smaller than the overall length "$H_1$" in FIG. 35 when a comparison is made between these two lengths.

Figure 37:
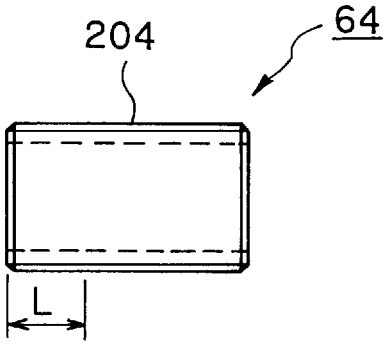
FIG. 37 is a side view, illustrating a filter stand pursuant to a second embodiment.
Figure 38:
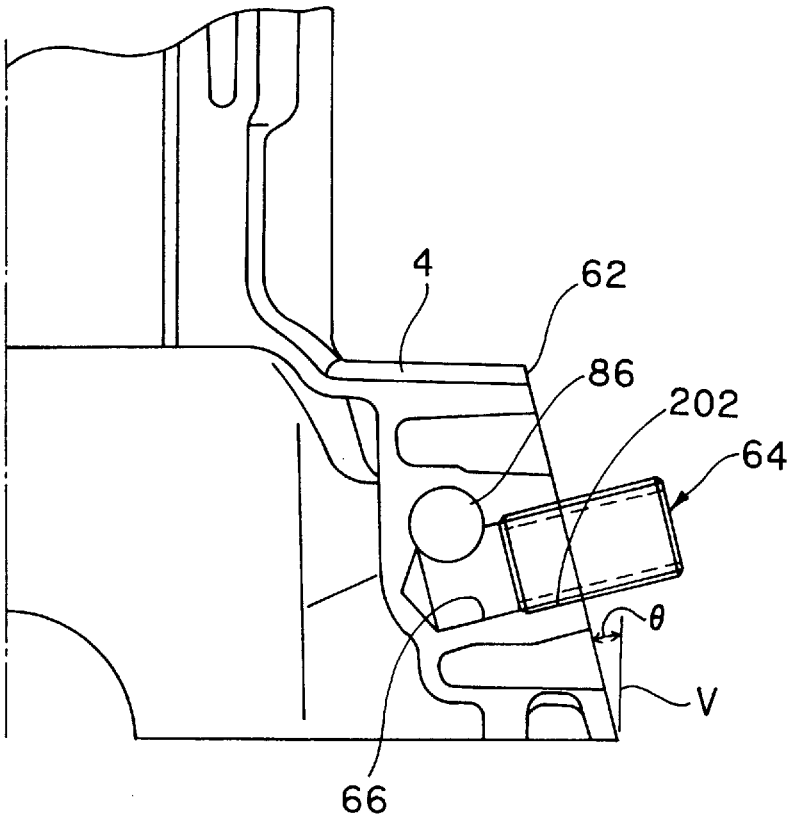
FIG. 38 is a cross-sectional view illustrating a state in which the filter stand of FIG. 37 is mounted on a cylinder block.
Figure 39:
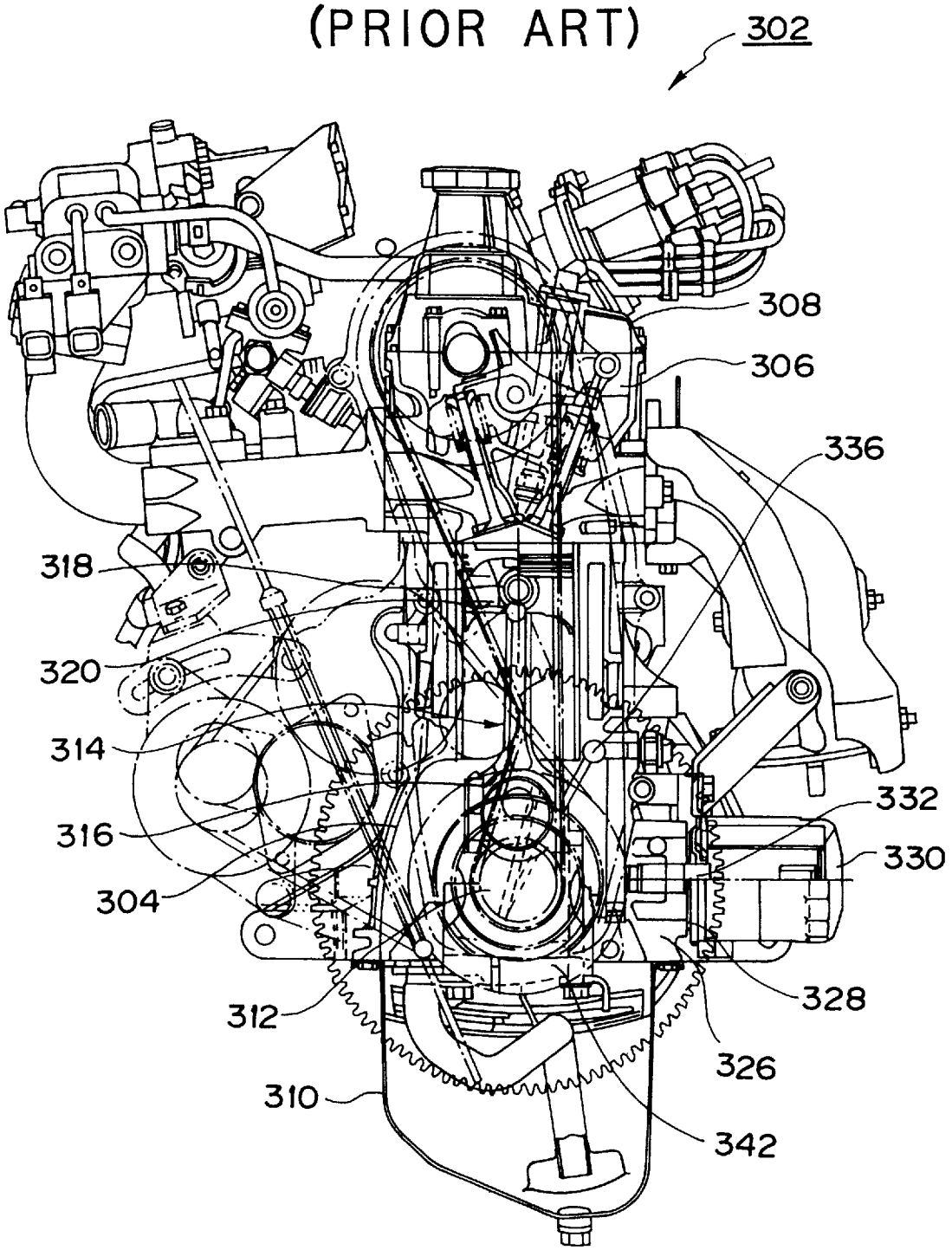
FIG. 39 (PRIOR ART)
FIG. 39 is a cross-sectional view showing a conventional engine.
Figure 40:
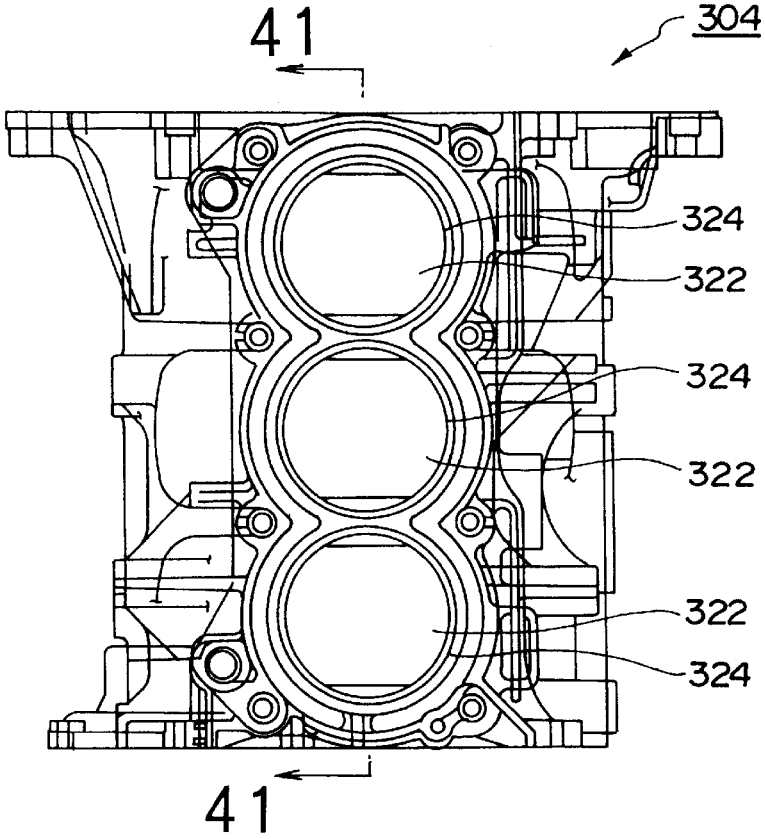
FIG. 40 (PRIOR ART)
FIG. 40 is a plan view showing a conventional cylinder block.
Figure 41:
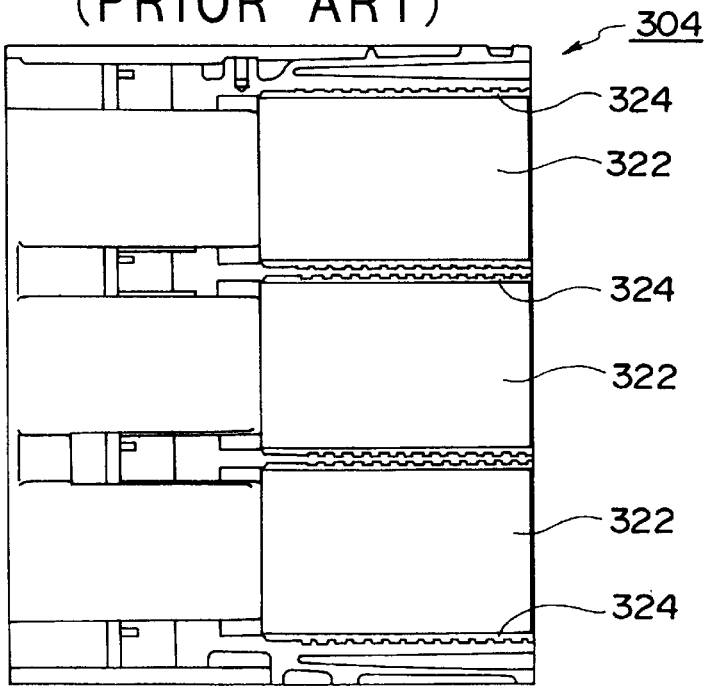
FIG. 41 (PRIOR ART)
FIG. 41 is a cross-sectional view taken along line 41—41 of FIG. 40.
Figure 42:
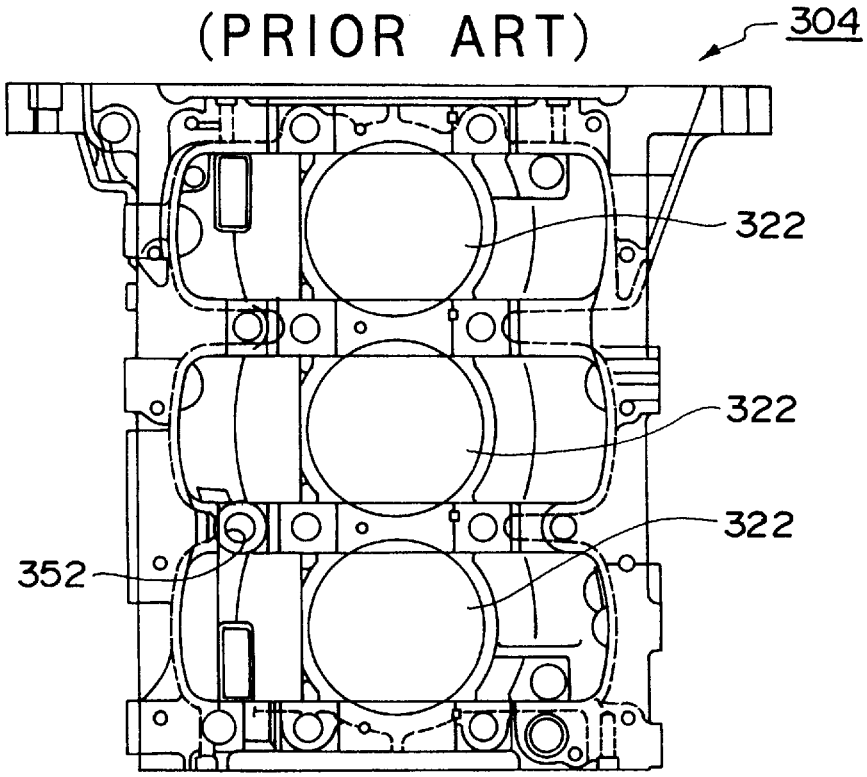
FIG. 42 (PRIOR ART)
FIG. 42 is a bottom view illustrating the conventional cylinder block.
Figure 43:
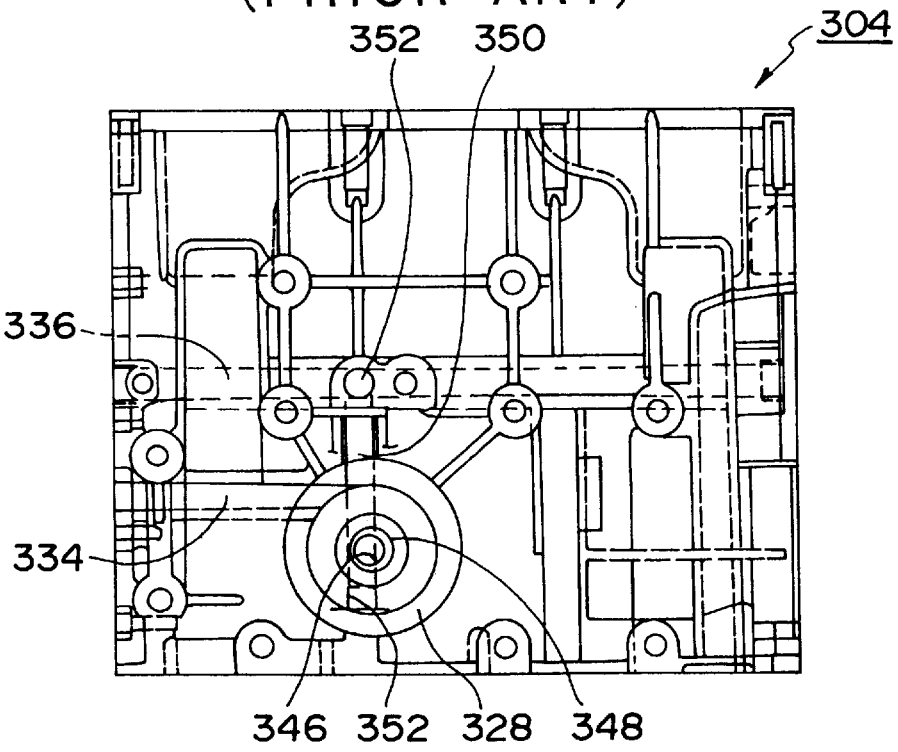
FIG. 43 (PRIOR ART)
FIG. 43 is a side view illustrating the conventional cylinder block.
Figure 44:
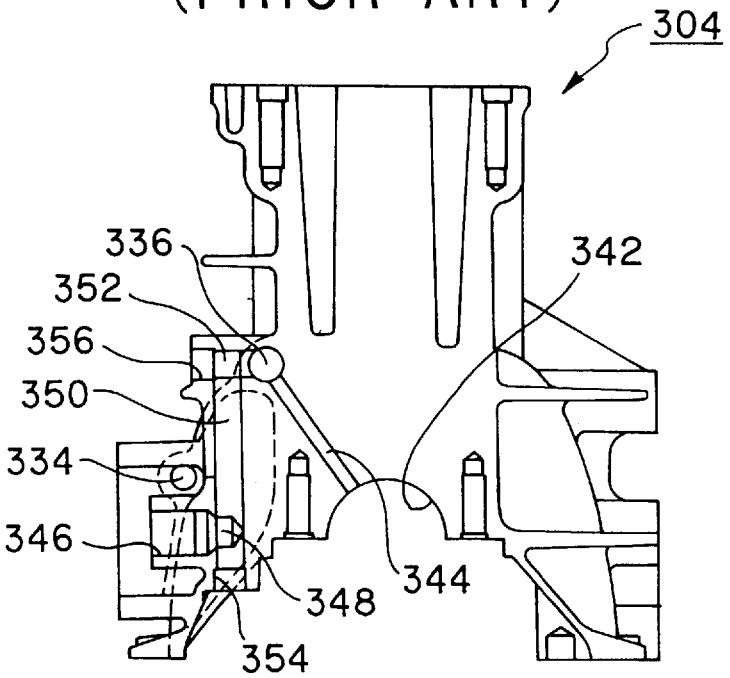
FIG. 44 (PRIOR ART)
FIG. 44 is a cross-sectional view illustrating a conventional deep skirt type of cylinder block.
Figure 45:
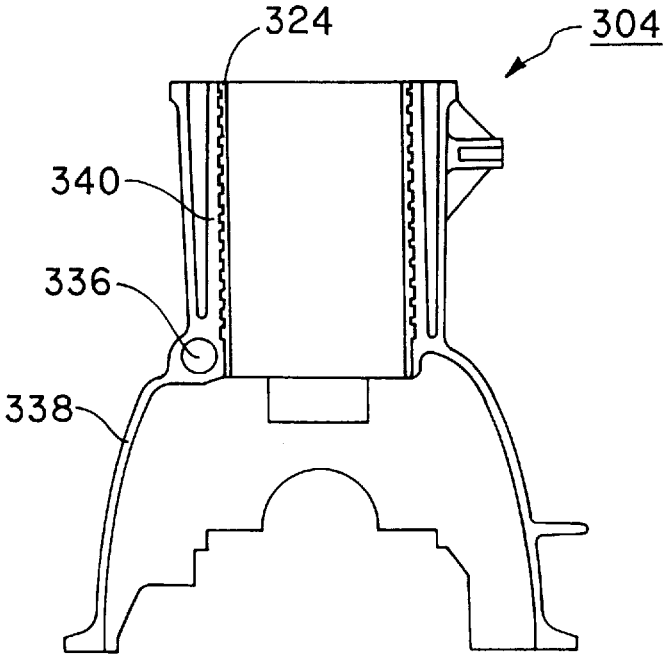
FIG. 45 (PRIOR ART)
FIG. 45 is a cross-sectional view illustrating the conventional deep skirt type of cylinder block.
Figure 46:
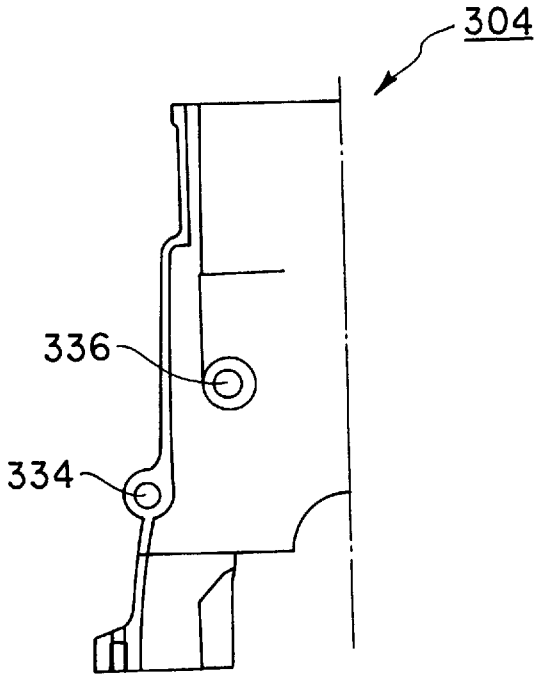
FIG. 46 (PRIOR ART)
FIG. 46 is a cross-sectional view showing a conventional parting type of cylinder block.
Figure 47:
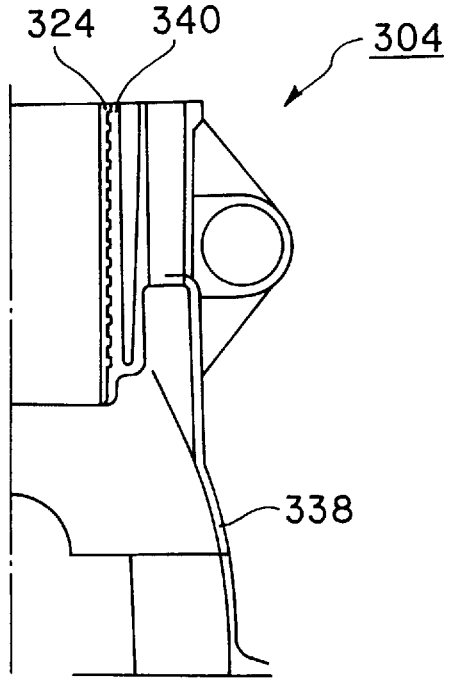
FIG. 47 (PRIOR ART)
FIG. 47 is a cross-sectional view showing the conventional parting type of cylinder block.
Figure 48:
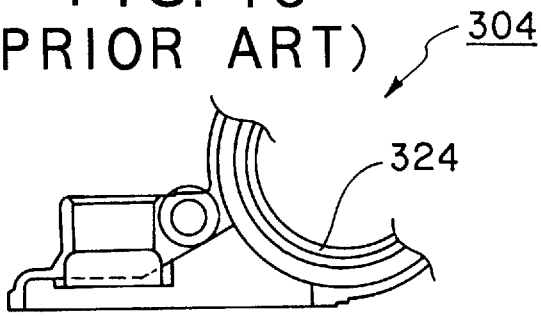
FIG. 48 (PRIOR ART)
FIG. 48 is a partial cross-sectional view illustrating a conventional cylinder block.
Figure 49:
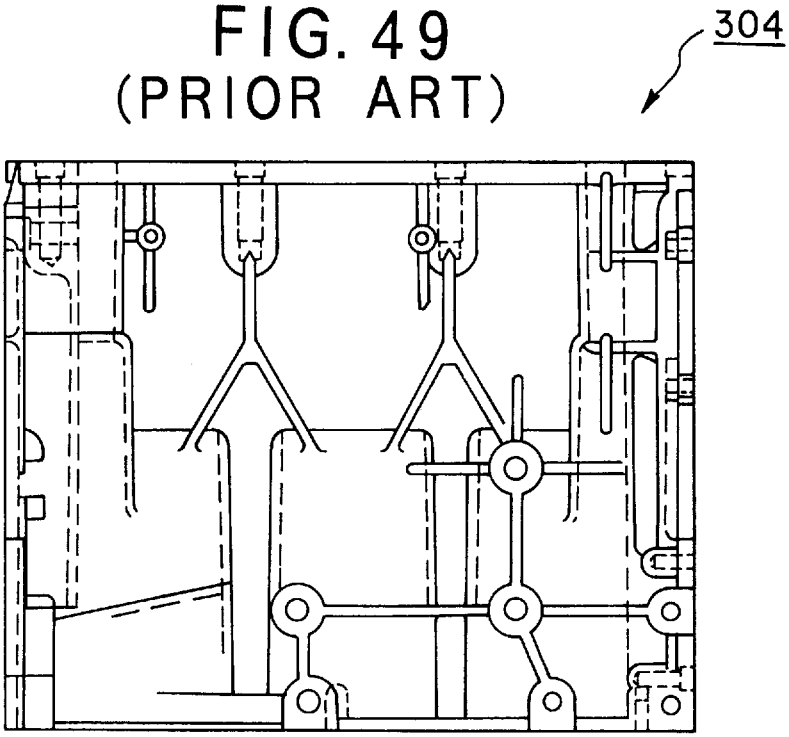
FIG. 49 (PRIOR ART)
FIG. 49 is a side view showing the conventional cylinder block.
Figure 50:
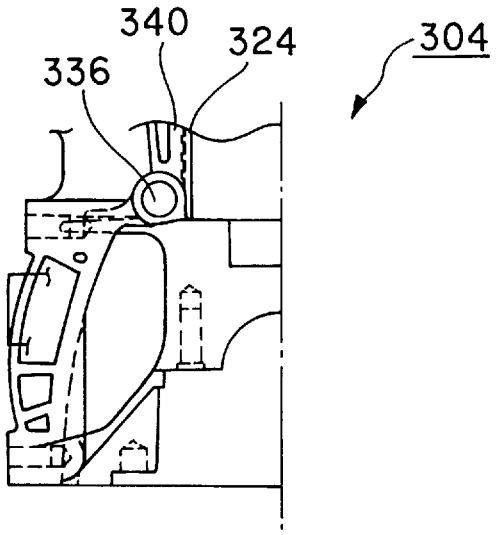
FIG. 50 (PRIOR ART)
FIG. 50 is a partial cross-sectional view showing the conventional cylinder block.
Figure 51:
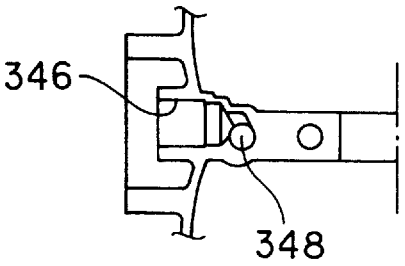
FIG. 51 (PRIOR ART)
FIG. 51 is a partial cross-sectional view showing the cylinder block of FIG. 50.
Figure 52:
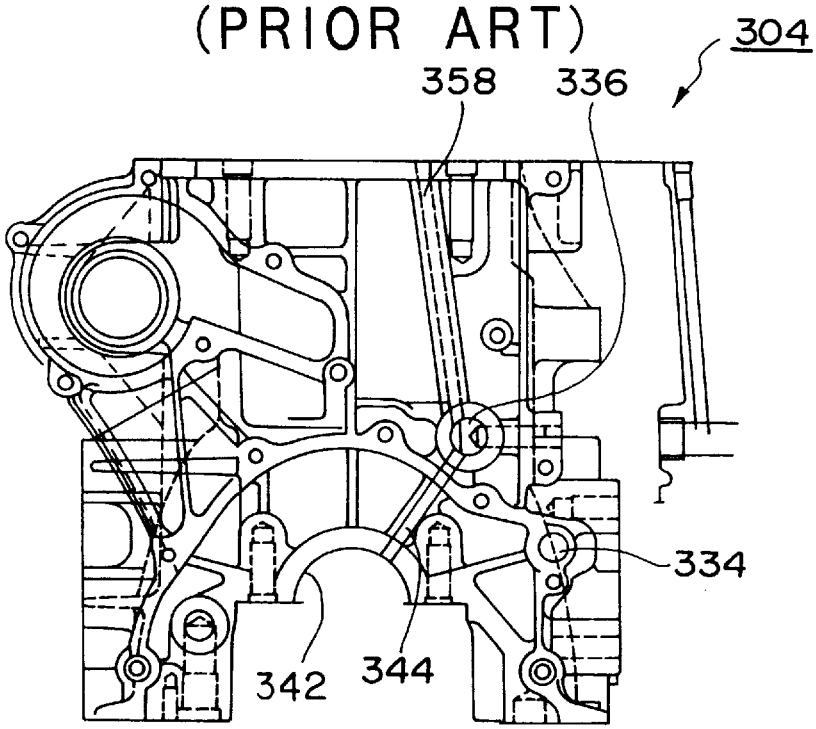
FIG. 52 (PRIOR ART)
FIG. 52 is a front view showing a conventional deep sleeve type of cylinder block.
Figure 53:
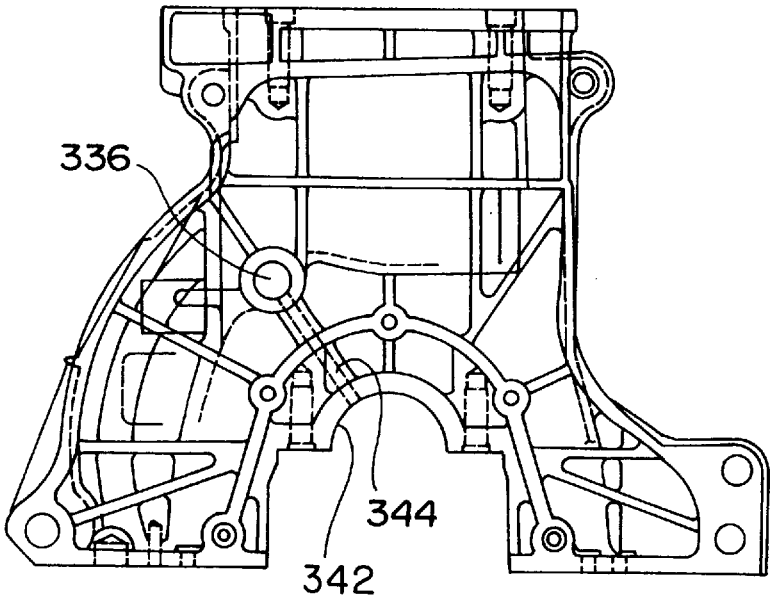
FIG. 53 (PRIOR ART)
FIG. 53 is a rear view showing the cylinder block of FIG. 52.
Figure 54:
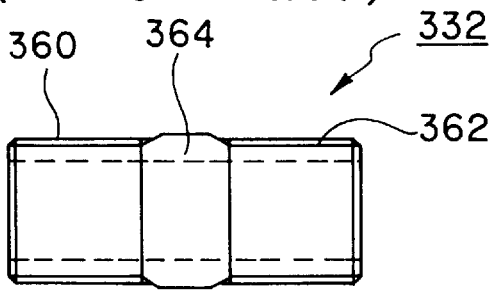
FIG. 54 (PRIOR ART)
FIG. 54 is a side view illustrating a conventional filter stand.
Figure 55:
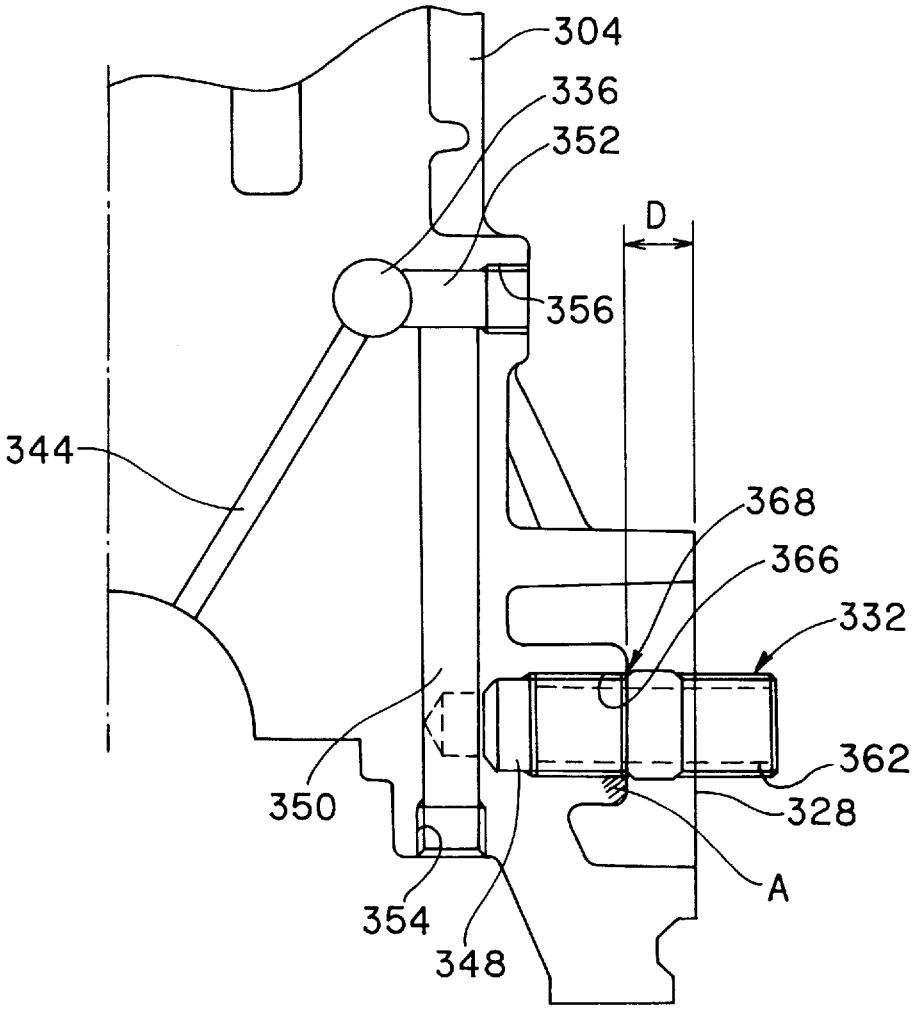
FIG. 55 (PRIOR ART)
FIG. 55 is a cross-sectional view illustrating a state in which the filter stand is conventionally mounted in the cylinder block.

FIGS. 37 and 38 illustrate a second embodiment of the invention. In describing this embodiment, the same reference numerals are used for features identical in function to those described in the first embodiment.

The second embodiment is characterized by a filter-mounting surface 62 at an outer portion 56 of a half-skirted cylinder block 4-1 is formed and inclined at angle θ with respect to vertical line "V". The slanted surface 62 is formed with a block-side threaded portion (internal thread) 202 in a direction perpendicular to the filter-mounting surface 62. An oil filter 58 is mounted on the slanted surface 62 through a filter stand 64. As illustrated in FIG. 37, the filter stand 64 has a stand-side threaded portion (external thread) 204 defined on the entire outer surface thereof.

When the oil filter 58 is mounted on the cylinder block 4, a screw-stopping agent (not shown) is applied to the stand-side threaded portion 204 over the range of length "L". Then, such longitudinal portion "L" of the threaded portion 204 having the agent thereon is brought into threading attachment to the block-side threaded portion 202. The stand-side threaded portion 204 is driven into the block-side threaded portion 202 until reaching the bottom of the latter threaded portion 202.

Since the entire outer surface of the filter stand 64 is threaded, then working processes of the filter stand 64 are decreased, resulting in a cost reduction. In addition, the full length of the filter stand 64 is reduced, thereby providing a reduction in size of the filter stand 64 itself.

Further, the smaller-sized filter stand 64 allows the oil filter 58 to be positioned close to the cylinder block 4 when being mounted on the cylinder block 4. As a result, the entire engine 2 can be made compact.

Yet further, even if the filter stand 64 is excessively tightened into the cylinder block 4, then stresses exerted on the opening edge of a filter-mounting surface 62 of the cylinder block 4 are reduced, thereby making it possible to prevent the occurrence of cracking or tearing thereat.

Still further, the filter-mounting surface 62, on which the oil filter 58 is placed, and a surface on which the filter stand 64 is mounted, can be the same one. As a result, the cylinder block 4 can be made lighter in weight.

Since the screw-stopping agent is used when the filter stand 64 is mounted on the cylinder block 4, then the filter stand 64 can be prevented from becoming loose or disengaged from the cylinder block when the oil filter 58 is removed.

As evidenced by the above-detailed description, the lubricating oil passage structure for the engine pursuant to one aspect of the present invention comprises: the sub-gallery and the main gallery positioned adjacent to one another in the cylinder block; the head-side oil passage and the journal-side oil passage both being communicated to the main gallery and provided in the cylinder block, in which the head-side oil passage is led to the upper surface of the cylinder block, while the journal-side oil passage is at a sideward slant such as to be oriented toward the journal portion of the crankshaft; the housing-side oil passage communicated to the journal-side oil passage, the housing-side oil passage being provided in the journal housing section of the cylinder block by the use of the spot facing for the housing bolt, the journal housing section supporting the journal portion; the metal-side oil passage communicated to the housing-side oil passage, the metal-side oil passage being provided in the journal housing section at the rear of the journal metal disposed between the journal portion and the journal housing section; and, the chain adjuster-side oil passage communicated to the metal-side oil passage, the chair adjuster-side oil passage being provided in the cylinder block. As a result, working processes of the oil passages are decreased, and component costs are lowered, thereby providing reduced cost. In addition, the lubricating oil passage structure is made lighter in weight. Further, component-assembling costs are reduced. Yet further, the overall lengths of the oil passages are reduced, thereby providing enhanced lubricating capability. Still further, satisfactory lubrication is provided to the chain adjuster at the time of start-up of the engine, and the chain adjuster can be brought into improved operation.

In the lubricating oil passage structure according to another aspect of the present invention, the filter-mounting surface of the cylinder block is provided with the block-side threaded portion, while the entire outer surface of the filter stand is provided with the stand-side threaded portion. The stand-side threaded portion is brought into threading attachment to the block-side threaded portion. As a result, working processes of the filter stand are decreased. In addition, the filter stand is made smaller in size, thereby providing the smaller-sized engine. Further, even if the oil stand is excessively tightened into the block-side threaded portion of the cylinder block, then cracking or tearing is prevented from occurring at the opening edge of the filter-mounting portion of the cylinder block. In addition, the filter-mounting surface and a surface, on which the filter stand is mounted, can be the same one; consequently, the cylinder block can be made lighter in weight. Further, the filter stand is made compact, and the oil filter can be positioned close to the cylinder block when being mounted on the cylinder block. As a result, a smaller-sized engine is achievable.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In a lubricating oil passage structure for an engine having a crankshaft rotatably supported on a cylinder block of the engine, a connecting rod provided in said cylinder block, a larger end portion of said connecting rod connected to said crankshaft, a smaller end portion of said connecting rod linked to a piston, said piston being reciprocably supported in a cylinder of said cylinder block through a sleeve, an oil filter mounted on a filter-mounting surface at an outer surface of said cylinder block, and a sub-gallery and a main gallery, both of said galleries provided in said cylinder block, in which said sub-gallery permits oil fed under pressure from an oil pump to be guided to said oil filter, and said main gallery distributes the oil from said oil filter to sections of said engine, the improvement comprising: said sub-gallery and said main gallery being provided adjacent one another in said cylinder block; a head-side oil passage and a journal-side oil passage both being in communication with said main gallery and provided in said cylinder block, said head-side oil passage is led to an upper surface of said cylinder block, said journal-side oil passage is slanted so as to be oriented toward a journal portion of said crankshaft; a housing-side oil passage in communication with said journal-side oil passage, said housing-side oil passage being provided in a journal housing section of said cylinder block by a spot facing for a housing bolt, said journal housing section supporting said journal portion; a metal-side oil passage in communication with said housing-side oil passage, said metal-side oil passage being provided in said journal housing section at the rear of a journal metal disposed between said journal portion and said journal housing section; and, a chain adjuster-side oil passage in communication with said metal-side oil passage, said chain adjuster-side oil passage being provided in said cylinder block.

2. A lubricating oil passage structure for an engine as defined in claim 1, wherein said main gallery is positioned so as to be closely fitted to an arcuate skirt surface of a skirt portion of said cylinder block, said main gallery being spaced apart from both piston support sleeve and a portion which press-fits said sleeve, said main gallery being provided substantially along said skirt portion, and wherein a sideways linear locus portion of a rod locus of said connecting rod is drawn, a gallery-connecting line connecting the center of said sub-gallery with the center of said main gallery is drawn, and any ones of said filter-mounting surface, said sideways linear locus portion, and said gallery-connection line are arranged substantially parallel to one another.

3. A lubricating oil passage structure for an engine as defined in claim 1, wherein said cylinder block includes a half-skirted cylinder block as an upper section and a block lower case as a lower section, and wherein, when said sub-gallery is provided adjacent to a case-mating surface of said block lower case, then said case-mating surface below said sub-gallery is positioned offset in an outward direction of said sub-gallery.

4. A lubricating oil passage structure for an engine as defined in claim 1, wherein said main gallery is provided with an opening of said journal-side oil passage so as to avoid an opening of said head-side oil passage.

5. A lubricating oil passage structure for an engine as defined in claim 1, wherein said journal-side oil passages are provided in said cylinder block along a reinforcing rib-shaped portion, said reinforcing rib-shaped portion extending to said skirt portion sideways from said journal housing section.

6. A lubricating oil passage structure for an engine as defined in claim 1, wherein said oils filter is mounted on said filter-mounting surface by a filter stand, wherein said filter-mounting surface is provided with a block-side threaded portion, and wherein the entire outer surface of said filter stand is provided with a stand-side threaded portion, said stand-side threaded portion being driven into threading attachment to said block-side threaded portion.

7. In a lubricating oil passage structure for an engine having an elongate crankshaft rotatably supported on and extending lengthwise of a cylinder block of the engine, the cylinder block having generally flat and substantially parallel upper and lower surfaces which extend lengthwise thereof and which are generally parallel with a longitudinally extending axis of rotation of the crankshaft, the cylinder block having a plurality of cylinders formed therein in generally parallel but spaced relation along the longitudinal length of the cylinder block so that the cylinders open downwardly from the upper surface of the cylinder block in generally perpendicular relationship therewith, said cylinders at lower ends thereof communicating with crank chambers defined in a lower portion of said cylinder block, said crankshaft having rotatable cranks disposed in the crank chambers, each crank being connected to one end of a connecting rod which at its other end connects to a piston which is reciprocably supported in a respective said cylinder through a support sleeve which is fixed in the cylinder, an oil filter mounted on a filter-mounting surface at an outer surface of said cylinder block, a sub-gallery formed in the cylinder block for permitting oil fed under pressure from an oil pump to be supplied to the oil filter, and a main gallery formed in the cylinder block for permitting oil from the oil filter to be distributed to sections of the engine, comprising the improvement wherein: said oil filter is mounted on a filter-mounting surface provided on an outer side surface of said cylinder block in inwardly spaced relation from opposite longitudinal ends of the cylinder block, said filter-mounting surface being disposed adjacent and projecting upwardly from the bottom surface of the cylinder block, said main gallery including a first elongate passage which extends generally throughout the length of said cylinder block adjacent one side thereof, said first passage being disposed adjacent but upwardly a small distance above the bottom surface of said cylinder block in close proximity to the filter mounting surface for communication with a first connecting passage which extends through the filter mounting surface for receiving oil discharged from the oil filter, said sub-gallery including an elongate second passage which extends lengthwise of the cylinder block from substantial one end thereof to a position adjacent the filter mounting surface, said second passage being disposed adjacent one side of the cylinder block and positioned adjacent but upwardly from said bottom surface whereby said second passage is disposed closely adjacent said first passage but is disposed generally between said bottom surface and said first passage, said second passage communicating with a second connecting passage which opens through the filter mounting surface for supplying oil to the oil filter, a head-side oil passage formed in said cylinder block for supplying oil to a cylinder head, said head-side oil passage communicating at one end with said main gallery and projecting upwardly therefrom along one side of said cylinder block and terminating at its other end at said upper surface, a journal-side oil passage formed in said cylinder block for supplying oil to a rotatable journal portion of said crankshaft which is rotatably supported in a journal housing section of said cylinder block, said journal-side oil passage being connected at one end to said main gallery and extending sidewardly and slanted downwardly for communication with the journal portion.

8. A lubricating oil passage structure according to claim 7, wherein said journal side oil passage communicates with an intermediate passage formed in a journal housing section of said cylinder block, said intermediate passage being defined by a bore which is formed in said cylinder block and opens upwardly from said bottom surface for accommodating a housing bolt, and said intermediate passage communicating with a journal supply passage which terminates at a journal sleeve which rotatably supports the journal portion of the crankshaft.

9. A lubricating oil passage structure according to claim 8, including a chain adjuster-side oil passage provided in said cylinder block and in communication with said journal supply passage.

10. A lubricating oil passage structure according to claim 8, wherein said cylinder block is a one-piece structure and said crankshaft is supported thereon so that the longitudinal rotational axis of the crankshaft is spaced upwardly a small distance from said bottom surface, and said first and second passages which define the respective main and sub-galleries are disposed at least slightly above a longitudinally extending transverse plane which contains the longitudinal rotational axis of the crankshaft.

11. A lubricating oil passage structure according to claim 8, wherein said cylinder block is defined by upper and lower block parts which respectively define opposed lower and upper mating surfaces which contact one another and extend generally parallel with the upper and lower surfaces of the cylinder block, and said first and second passages being formed in said upper block part closely adjacent but upwardly from said lower mating surface.

* * * * *

UNITED STATES PATENT AND TRADEMARK OFFICE

CERTIFICATE OF CORRECTION

PATENT NO. : 5,887,565

DATED : March 30, 1999

INVENTOR(S) : Hisashi OZEKI et al

It is certified that error appears in the above-identified patent and that said Letters Patent is hereby corrected as shown below:

Column 13, line 16; change "oils" to ---oil---.

Signed and Sealed this

Fourth Day of January, 2000

*Attest:*

*Attesting Officer*

*Acting Commissioner of Patents and Trademarks*

UNITED STATES PATENT AND TRADEMARK OFFICE

CERTIFICATE OF CORRECTION

PATENT NO. : 5 887 565

DATED : March 30, 1999

INVENTOR(S) : Hisashi OZEKI et al

It is certified that error appears in the above-identified patent and that said Letters Patent is hereby corrected as shown below:

Column 14; lines 41 and 42;
change "claim 8" to ---claim 7---.

Column 14; lines 50 and 51;
change "claim 8" to ---claim 7---.

Signed and Sealed this

Seventh Day of March, 2000

*Attest:*

*Attesting Officer*

Q. TODD DICKINSON

*Commissioner of Patents and Trademarks*